US010845141B2

(12) United States Patent
Fitzgerald

(10) Patent No.: US 10,845,141 B2
(45) Date of Patent: Nov. 24, 2020

(54) MULTI-BARREL SPLIT-BREACH RAPID FIRE GUN

(71) Applicant: Brendon Zinsner, Sarasota, FL (US)

(72) Inventor: Lisa Fitzgerald, Leesburg, FL (US)

(73) Assignee: Brendon Zinsner, Sarasota, FL (US)

( * ) Notice: Subject to any disclaimer, the term of this patent is extended or adjusted under 35 U.S.C. 154(b) by 0 days.

(21) Appl. No.: 16/690,462

(22) Filed: Nov. 21, 2019

(65) Prior Publication Data

US 2020/0158453 A1 May 21, 2020

Related U.S. Application Data

(60) Provisional application No. 62/770,238, filed on Nov. 21, 2018.

(51) Int. Cl.

| | |
|---|---|
| ***F41A 9/36*** | (2006.01) |
| ***F41A 9/30*** | (2006.01) |
| ***F41A 19/21*** | (2006.01) |
| ***F41A 21/06*** | (2006.01) |
| ***F41A 9/34*** | (2006.01) |
| *F41A 9/79* | (2006.01) |

(52) U.S. Cl.
CPC ..... *F41A 9/36* (2013.01); *F41A 9/30* (2013.01); *F41A 9/34* (2013.01); *F41A 19/21* (2013.01); *F41A 21/06* (2013.01); *F41A 9/79* (2013.01)

(58) Field of Classification Search
CPC .... F41A 9/36; F41A 9/35; F41A 21/06; F41A 9/30; F41A 9/34; F41A 19/21; F41A 9/79
USPC ..... 89/12
See application file for complete search history.

(56) References Cited

U.S. PATENT DOCUMENTS

| | | | | | |
|---|---|---|---|---|---|
| 323,997 | A * | 8/1885 | Allender | F41A 7/08 | 89/12 |
| 332,741 | A * | 12/1885 | Palmer | F41A 9/36 | 89/12 |
| 504,831 | A * | 9/1893 | Gatling | F41A 9/36 | 89/12 |
| 3,041,939 | A * | 7/1962 | Dardick | F41A 19/58 | 89/126 |
| 3,160,021 | A * | 12/1964 | Hereth | F41A 9/42 | 74/89.37 |
| 3,262,367 | A * | 7/1966 | Martwick | F41A 9/30 | 89/13.05 |
| 3,492,913 | A * | 2/1970 | Barnard | F41A 9/36 | 89/33.03 |
| 3,776,416 | A * | 12/1973 | Ashley | F41F 1/10 | 221/21 |
| 4,210,058 | A * | 7/1980 | Chiabrandy | F41A 9/36 | 89/12 |
| 4,301,709 | A * | 11/1981 | Bohorquez | F41A 17/18 | 89/11 |

(Continued)

*Primary Examiner* — Joshua E Freeman
(74) *Attorney, Agent, or Firm* — Shumaker, Loop & Kendrick, LLP

(57) ABSTRACT

The multi-barrel split-breech rapid fire gun is a light-weight, electrically-driven rapid fire gun, radially loaded and fired, using only rotating parts. This eliminates inertia problems compared to a breech-loaded gun that requires a bolt to chamber a cartridge. The firing mechanism allows the cartridge to be enclosed in a split-breech for 50% one rotation of the barrel hub. The gun incorporates an independent firing pin for each barrel to allow for high firing rates. The gun is fed by a thin polyimide cartridge belt fan-folded in a detachable wet-magazine.

17 Claims, 26 Drawing Sheets

(56) References Cited

U.S. PATENT DOCUMENTS 4,418,607 A * 12/1983 Price ..... F41A 9/30
89/11
4,457,209 A * 7/1984 Scheurich ..... F41A 9/14
89/34
4,481,858 A * 11/1984 Price ..... F41A 9/30
89/11
4,681,019 A * 7/1987 Brandl ..... F41A 9/76
89/33.04
4,735,126 A * 4/1988 Koine ..... F41A 9/04
89/126
5,115,713 A * 5/1992 Muller ..... F41A 9/04
89/33.14
6,339,983 B1 * 1/2002 Mannhart ..... F41A 9/04
89/33.01
10,352,638 B1 * 7/2019 Day ..... F41A 9/38
2011/0083654 A1 * 4/2011 Galinson ..... F41B 11/54
124/59
2011/0120292 A1 * 5/2011 Garwood ..... F41A 9/36
89/33.25
2012/0118132 A1 * 5/2012 Coker ..... F41A 9/46
89/13.05
2015/0300772 A1 * 10/2015 Carson ..... F41A 21/06
42/17
2016/0195349 A1 * 7/2016 Rowe ..... F41A 35/02
89/12
2017/0205167 A1 * 7/2017 Abbott ..... F41A 9/30
2018/0209762 A1 * 7/2018 Schneider ..... F41F 1/08
2018/0231343 A1 * 8/2018 Schneider ..... F41A 19/01
2018/0231344 A1 * 8/2018 Schneider ..... F41A 25/12
2020/0096270 A1 * 3/2020 Cleary ..... F41A 9/31
2020/0141676 A1 * 5/2020 Ralston ..... F41A 9/26

* cited by examiner

MULTI-BARREL SPLIT-BREACH RAPID FIRE GUN

TECHNICAL FIELD

The present invention relates generally to the field of machine guns, and more particularly, to rapid fire rotating multi-barrel machine guns and the cartridge loading and ejection mechanisms in these guns.

BACKGROUND

Rapid fire multi-barrel guns have been used in military conflicts since the invention of the Gatling gun in the mid-19th century. These guns have the advantage of covering large areas of land and/or air with a high density of projectiles in a very short time period. Applications of this type of weapon are from flushing combatants out of thick jungles to launching a wall of projectiles to protect from high-speed missile attacks. Most modern rapid fire guns are heavy and require a large power source to operate. Some have been miniaturized for transport by one solider but are still very heavy and awkward to handle.

The current designs suffer from the need to use a delinker, inertia problems with the bolt action, and cam dwell problems in the firing position. This limits consistent fire rates to approximately 4000 rounds per minute, an inherent problem with axial breech-loaded rapid fire weapons.

The invention described herein is a radial loaded split-breech rapid fire gun. Split-breech designs have been tried previously for rapid firing guns such as the Fokker-Leimberger design at the close of WWII. This design and others like it use a nutcracker-type mechanism where the cartridge is chambered with a split-breech system by two rotating synchronized wheels with a plurality of chamber slots. The obvious problem with the mechanism is that the chamber is, in effect, closed for a very small-time window. This limits the speed that the wheels can turn due to deflagration and firing pin timing. In the case of the Fokker-Leimberger design, cartridge casings were split due to the low chambering time and cartridge ignition timing.

SUMMARY

Thus, disclosed is a multi-barrel split-breech rapid fire gun that incorporates a multi-barrel assembly having a barrel hub with a plurality of barrels attached. Each barrel location around the barrel hub includes a half-chamber feature, concentric with the barrel bore at the proximal end of each barrel. This is one side of the split-breech system. The other side is a continuous chain with half-chambers as a feature of each link. The chain runs concentric to the barrel hub and the half-chamber features of each link are coincident with the barrel hub chamber feature. The chain drive system is synchronized to the barrel hub by chain sprockets, gear-driven by a drive gear affixed to the barrel hub.

The barrel hub is rotated by an electrical motor and gear reduction. The barrel hub also includes a plurality of firing pins, one for each barrel, and a cam-driven system to spring load and release each firing pin at the correct firing time. A high-temperature polyimide belt connecting a plurality of cartridges is fan-folded in a wet-magazine. A portion of the unused space in the magazine is filled with water, propylene glycol and 1% silicone lubricant. This mixture is transferred by the cartridge belt to cool and lubricate the high-speed mechanism. This magazine snap fits into a receiver located at the bottom of the gun. A boss feature and a spring, as part of the magazine, positions the first cartridge on the belt to be captured when the magazine is inserted.

As the barrel hub rotates, this polymeric belt (e.g., polyimide belt) with a plurality of cartridges affixed at a proper spacing, are captured and the cartridges nested into the half-chamber features on the barrel hub. As the barrel hub continues to rotate, the cartridges are enclosed by the half-chamber feature on the chain links. At the point in the barrel hub revolution where both half-chambers are concentric and fully encase a cartridge, the relative firing pin is released and the bullet is fired through the barrel. The cartridge remains fully chambered for 180 degrees of the barrel hub rotation. The cam that controls firing pin release time can be independently adjusted to control ignition timing within this 180-degree arc. With long chamber times, speed can be increased as the firing mechanism timing becomes less critical.

The internal pressure of the cartridge is contained within the half-chamber chain link and half-chamber feature in the barrel hub. A pressure fence, as part of the main frame enclosure, concentric to the barrel hub and within the firing positions, and in close proximity to the chain link top surface, limits any blow-out travel of the link as a result of internal chamber pressure. The interface between the half-chambered link and the half-chambered hub is sealed by means of the high-temperature polyimide belt that also connects each cartridge to the adjacent cartridge.

As the empty cartridges are rotated around the barrel hub, the chain link half-chamber separates from the barrel hub and is taken up by the chain sprocket on the exit side. A slot in the barrel hub and a pawl, part of the receiver assembly, strips the empty cartridges and belt off the barrel hub to be routed through an aperture in the front housing and out of the gun.

A rechargeable battery is magnetically and electrically attached to the gun to provide power to the drive motor.

In certain aspects, disclosed is a multi-barrel split-breech rapid fire gun comprising (a) a housing with a handle and trigger positioned thereon, the trigger operatively connected to a motor drive assembly; (b) a motor drive assembly arranged within the housing having a rotation member that rotates when the trigger is actuated; (c) a chain drive assembly that is operatively connected to the rotation member of the motor drive assembly, the chain drive assembly comprising an endless belt having a plurality of connected, individual links, with each individual link having a half breech or chamber formed thereon and in which the endless belt is configured to rotate within the gun when the trigger is actuated; (d) a firing assembly that is adjacent to and operatively connected to the chain drive assembly and motor drive assembly, the firing assembly comprising: (i) a plurality of rotatable barrels arranged on the multi-barrel split-breech rapid fire gun that are spaced apart from the trigger; (ii) a rotatable barrel hub with a plurality of cartridge half breeches or chambers formed thereon, the rotatable barrel hub synchronously rotates with the individual links of the endless belt such that each cartridge half breech or chamber formed on the rotatable barrel hub is configured to align with a corresponding half breech or chamber formed on each individual link of the endless belt to form a complete cartridge breech or chamber that is configured to temporarily house a cartridge therein before firing the cartridge through one barrel of the plurality of rotatable barrels; and (iii) a cartridge inlet configured to align with a cartridge magazine and a spent cartridge outlet arranged opposite to the cartridge inlet; and (e) optionally a cartridge magazine configured to releasably and securely mate to the housing and align with the cartridge inlet such that cartridges are fed from the magazine through the cartridge inlet into the complete cartridge breech or chamber formed by the aligned half breeches or chambers and rotate through the firing assembly such that spent cartridges exit the cartridge outlet such that the spent cartridges remain linked to one another after exiting the cartridge outlet.

In certain aspects, the cartridge magazine is present in the multi-barrel split-breech rapid fire gun.

In certain aspects in the multi-barrel split-breech rapid fire gun, the cartridge magazine houses a plurality of connected cartridges with each cartridge connected to another cartridge by a flexible polymeric belt and includes a lubricating solution that partially coats the plurality of connected cartridges therein.

In certain aspects in the multi-barrel split-breech rapid fire gun, the lubricating solution is configured to cool and lubricate the firing assembly when firing cartridges from the gun and comprises a mixture of water, an unsaturated polyol, and silicone.

In certain aspects in the multi-barrel split-breech rapid fire gun, the firing assembly further comprises a plurality of biased rotatable firing pins, with at least one firing pin of the plurality of biased rotatable firing pins configured to axially align with the complete cartridge breech or chamber formed within the gun while in use and to move in a linear direction from the handle towards one barrel of the plurality of rotatable barrels to fire the cartridge through one barrel of the plurality of rotatable barrels.

In certain aspects in the multi-barrel split-breech rapid fire gun, the rotation member of motor drive assembly comprises a plurality of sprockets that are operatively connected to a drive motor, the plurality of sprockets are arranged to contact an inner surface of the endless belt and rotate the endless belt within the multi-barrel split breech rapid fire gun.

In certain aspects in the multi-barrel split-breech rapid fire gun, the half breech or chamber of each link is formed on an outer surface of the endless belt opposite the inner surface of the endless belt.

In certain aspects, the multi-barrel split breech rapid fire gun further comprises a firing pin cam that houses the plurality of firing pins therein, an inner surface of the firing pin cam arranged as partially concentric rings having raised and recess portions in which when each rotatable firing pin rotates immediately from the raised to recess portion of the firing pin cam the firing pin moves radially outward aligning with a biasing cavity that biases the firing pin in a linear direction from the handle towards one barrel of the plurality of rotatable barrels to fire the cartridge through one barrel of the plurality of rotatable barrels.

In certain aspects, the multi-barrel split breech rapid fire gun is an automatic or semi-automatic firearm.

In certain aspects, the multi-barrel split breech rapid fire gun is a semi-automatic firearm.

In certain aspects, also disclosed is a plurality of assemblies configured for a multi-barrel split-breech rapid fire gun, the plurality of assemblies comprising: (a) a chain drive assembly that configure to be operatively connected to a rotation member of a motor drive assembly in a multi-barrel split-breech rapid fire gun, the chain drive assembly comprising an endless belt having a plurality of connected, individual links, with each individual link having a half breech or chamber formed thereon and in which the endless belt is configured to rotate within the gun when a trigger is actuated; (b) a firing assembly configured to be adjacent to and operatively connected to the chain drive assembly, the firing assembly comprising: (i) a plurality of rotatable barrels to be arranged on the multi-barrel split-breech rapid fire gun; (ii) a rotatable barrel hub with a plurality of cartridge half breeches or chambers formed thereon, the rotatable barrel hub configured to synchronously rotate with the individual links of the endless belt such that each cartridge half breech or chamber formed on the rotatable barrel hub is configured to align with a corresponding half breech or chamber formed on each individual link of the endless belt to form a complete cartridge breech or chamber that is configured to temporarily house a cartridge therein before firing a cartridge through one barrel of the plurality of rotatable barrels; and (iii) a cartridge inlet configured to align with a cartridge magazine and a spent cartridge outlet arranged opposite to the cartridge inlet.

In certain aspects, the plurality of assemblies further comprises: (c) a cartridge magazine configured to releasably and securely align with the cartridge inlet such that cartridges are configured to be fed from the magazine through the cartridge inlet into the complete cartridge breech or chamber formed by the aligned half breeches or chambers and rotate through the firing assembly such that spent cartridges exit the cartridge outlet such that the spent cartridges remain linked to one another after exiting the cartridge outlet.

In certain aspects in the plurality of assemblies, the cartridge magazine houses a plurality of connected cartridges with each cartridge connected to another cartridge by a flexible polymeric belt and includes a lubricating solution that partially coats the plurality of connected cartridges therein.

In certain aspects in the plurality of assemblies, the lubricating solution is configured to cool and lubricate the firing assembly when firing cartridges from the gun and comprises a mixture of water, an unsaturated polyol, and silicone.

In certain aspects in the plurality of assemblies, the firing assembly further comprises a plurality of biased rotatable firing pins, with at least one firing pin of the plurality of biased rotatable firing pins configured to axially align with the complete cartridge breech or chamber formed within the gun while in use and to move in a linear direction from the handle towards one barrel of the plurality of rotatable barrels to fire the cartridge through one barrel of the plurality of rotatable barrels.

In certain aspects in the plurality of assemblies, the half breech or chamber of each link is formed on an outer surface of the endless belt opposite the inner surface of the endless belt, with the inner surface of the endless belt configured to directly contact a rotation member of a motor drive assembly.

In certain aspects, the plurality of assemblies further comprises a firing pin cam that houses the plurality of firing pins therein, an inner surface of the firing pin cam arranged as partially concentric rings having raised and recess portions in which when each rotatable firing pin rotates immediately from the raised to recess portion of the firing pin cam, the firing pin moves radially outward aligning with a biasing cavity that biases the firing pin in a linear direction from the handle towards one barrel of the plurality of rotatable barrels to fire the cartridge through one barrel of the plurality of rotatable barrels.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be thorough and complete, and will fully convey the scope of the invention and enable one of ordinary skill in the art to make, use and practice the invention. Like reference numbers refer to like elements throughout the various drawings.

The embodiment described depicts a mechanism that incorporates a small caliber rim fire cartridge. This invention is scalable to any size, rim fire or center fire, cartridge.

Figure 1:
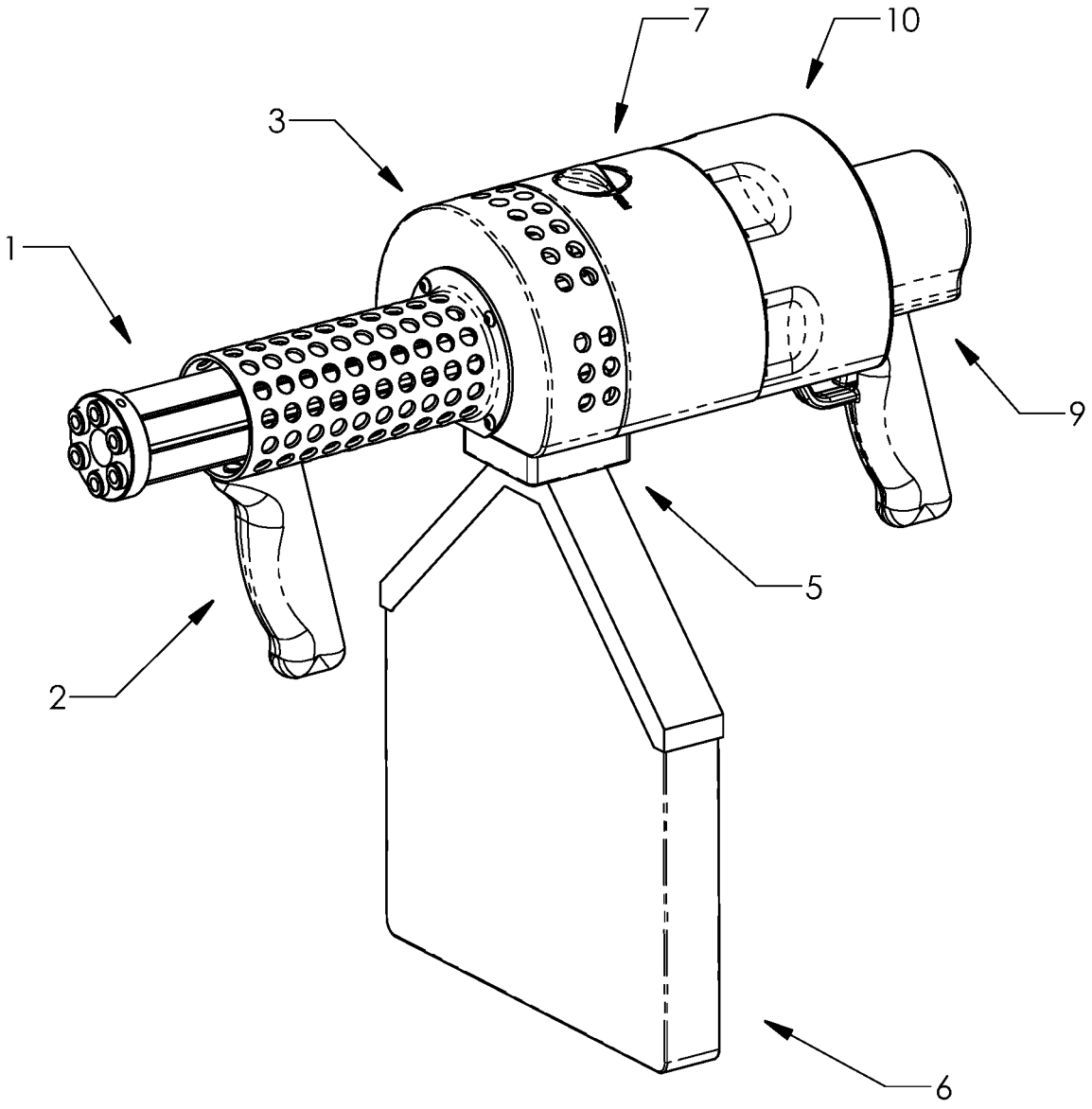
FIG. 1 is an Isometric view of the Multi-Barrel Split-breech Rapid Fire Gun.
Figure 2:
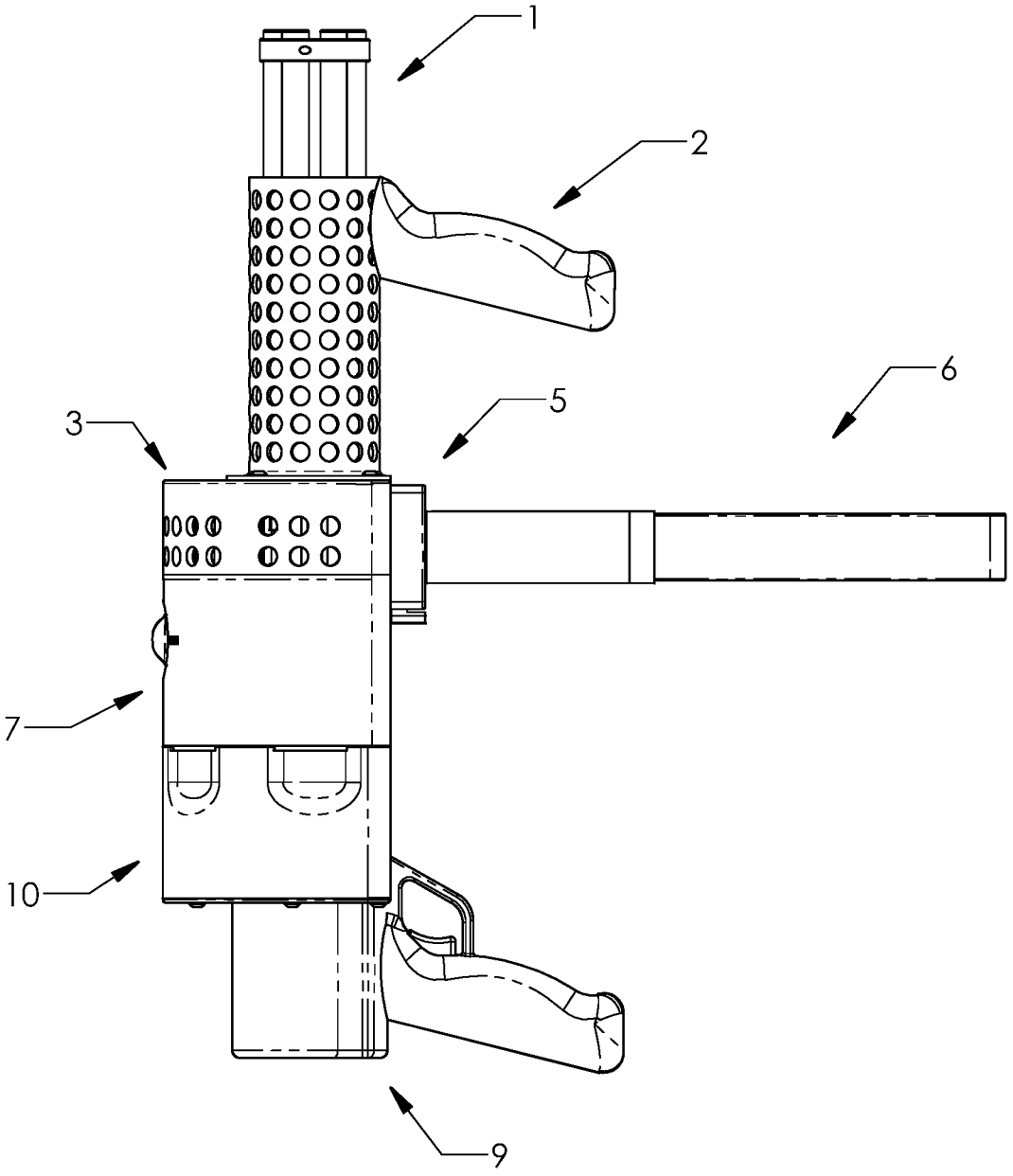
FIG. 2 is a Right view of the Multi-Barrel Split-breech Rapid Fire Gun.
Figure 3:
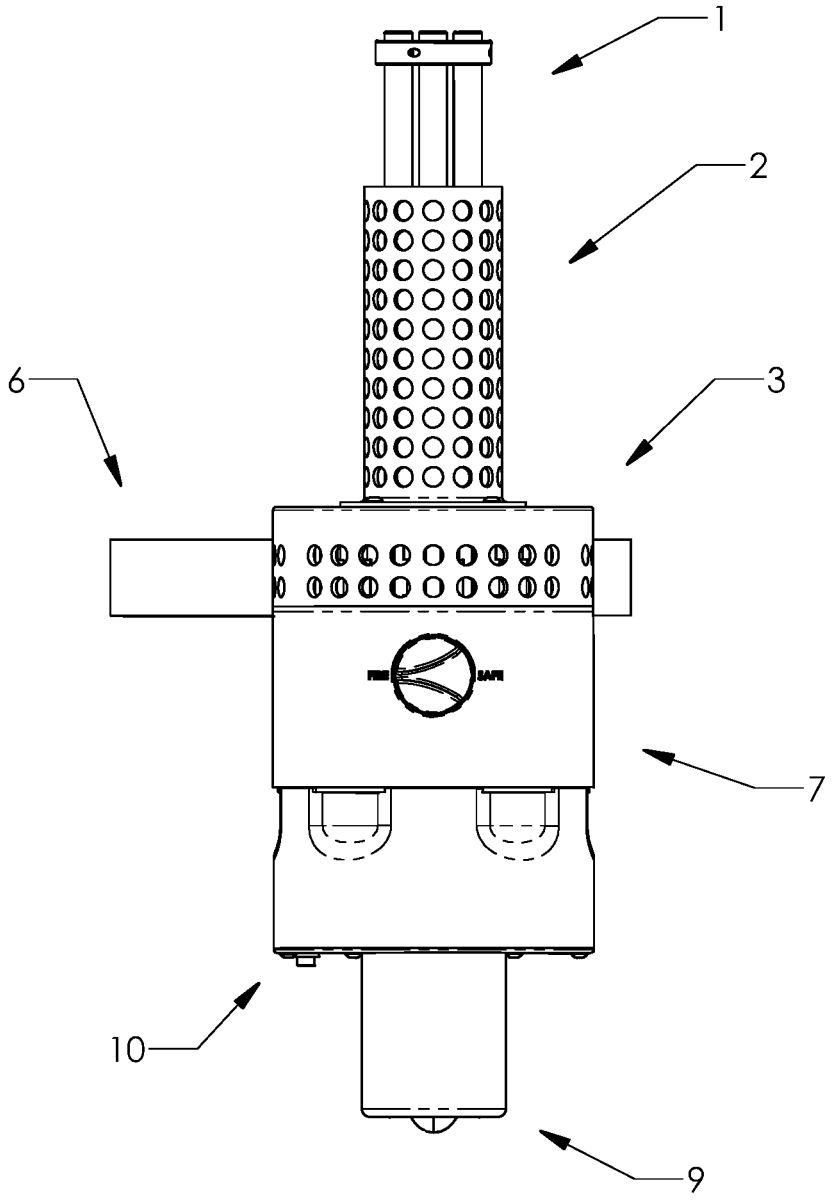
FIG. 3 is a Top view of the Multi-Barrel Split-breech Rapid Fire Gun.
Figure 4:
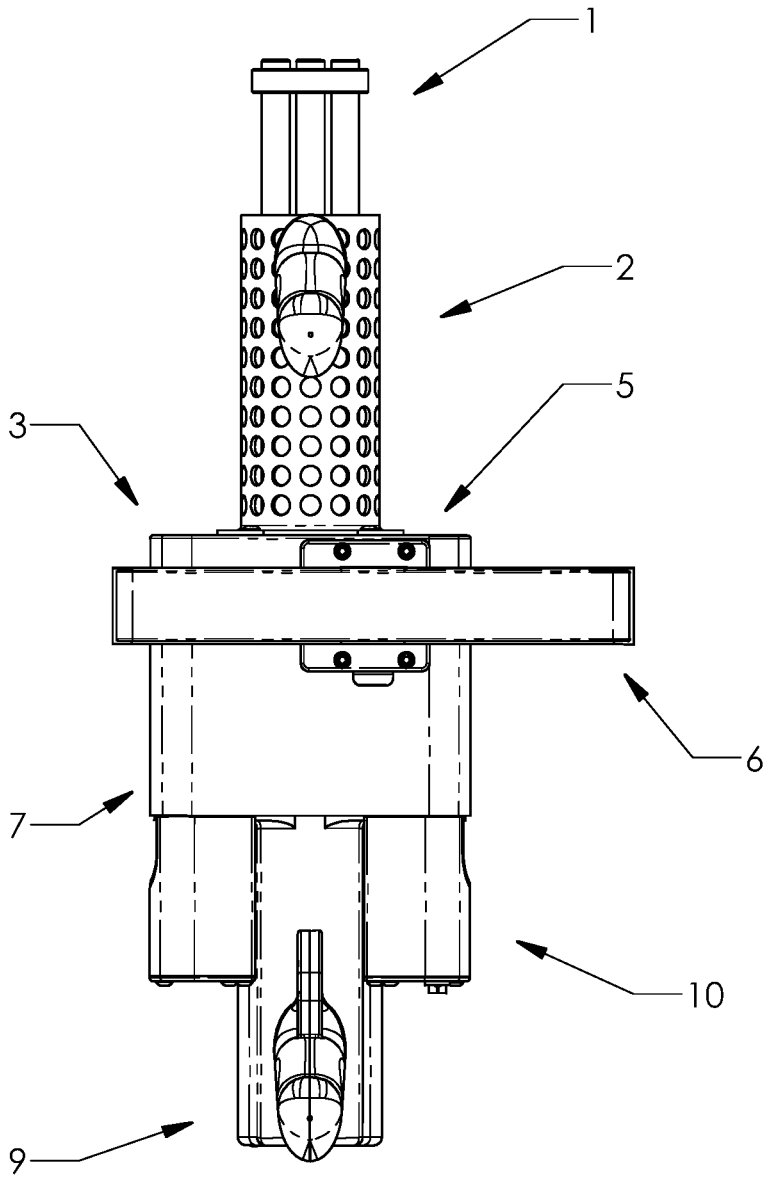
FIG. 4 is a Bottom view of the Multi-Barrel Split-breech Rapid Fire Gun.
Figure 5:
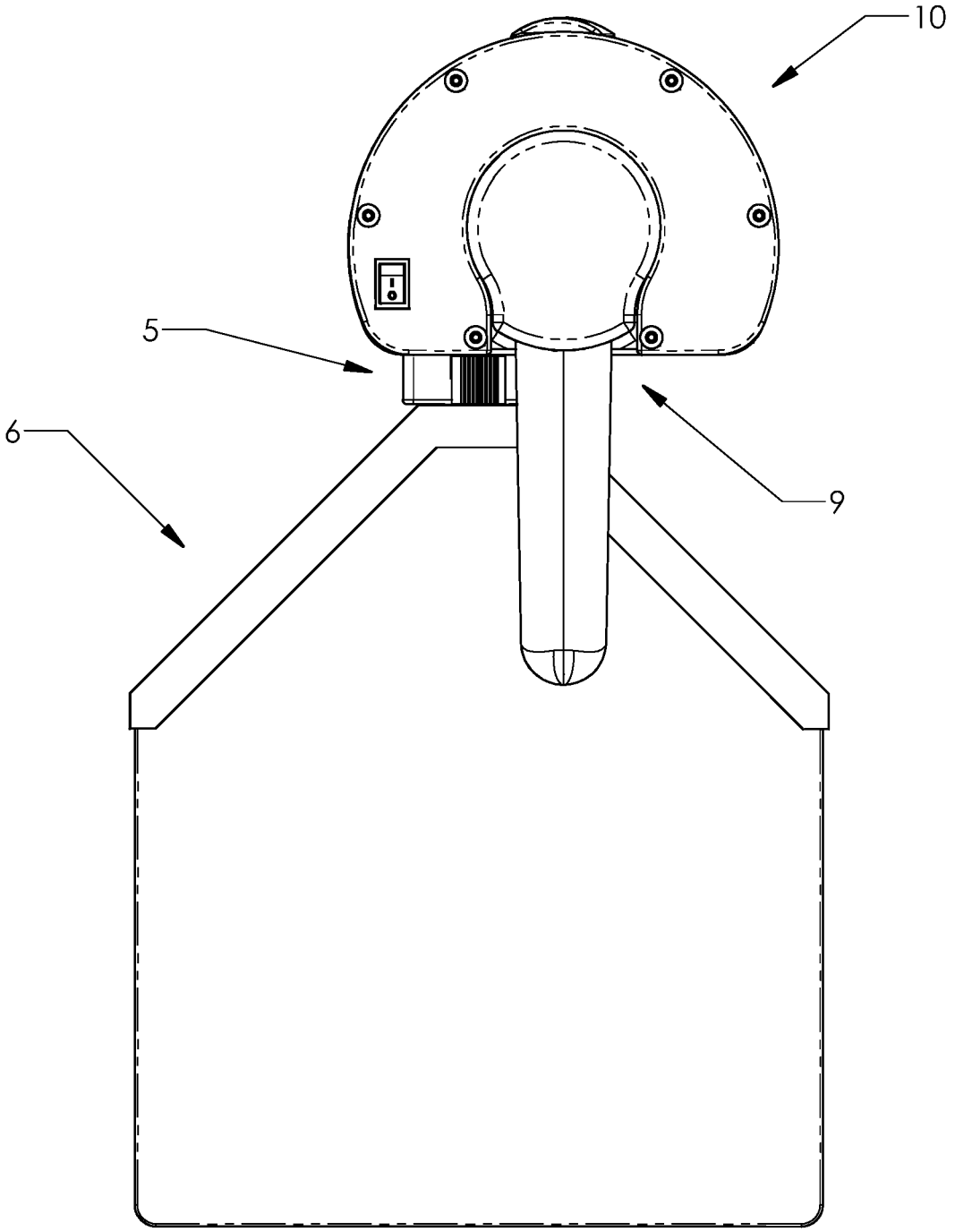
FIG. 5 is a Back view of the Multi-Barrel Split-breech Rapid Fire Gun.
Figure 6:
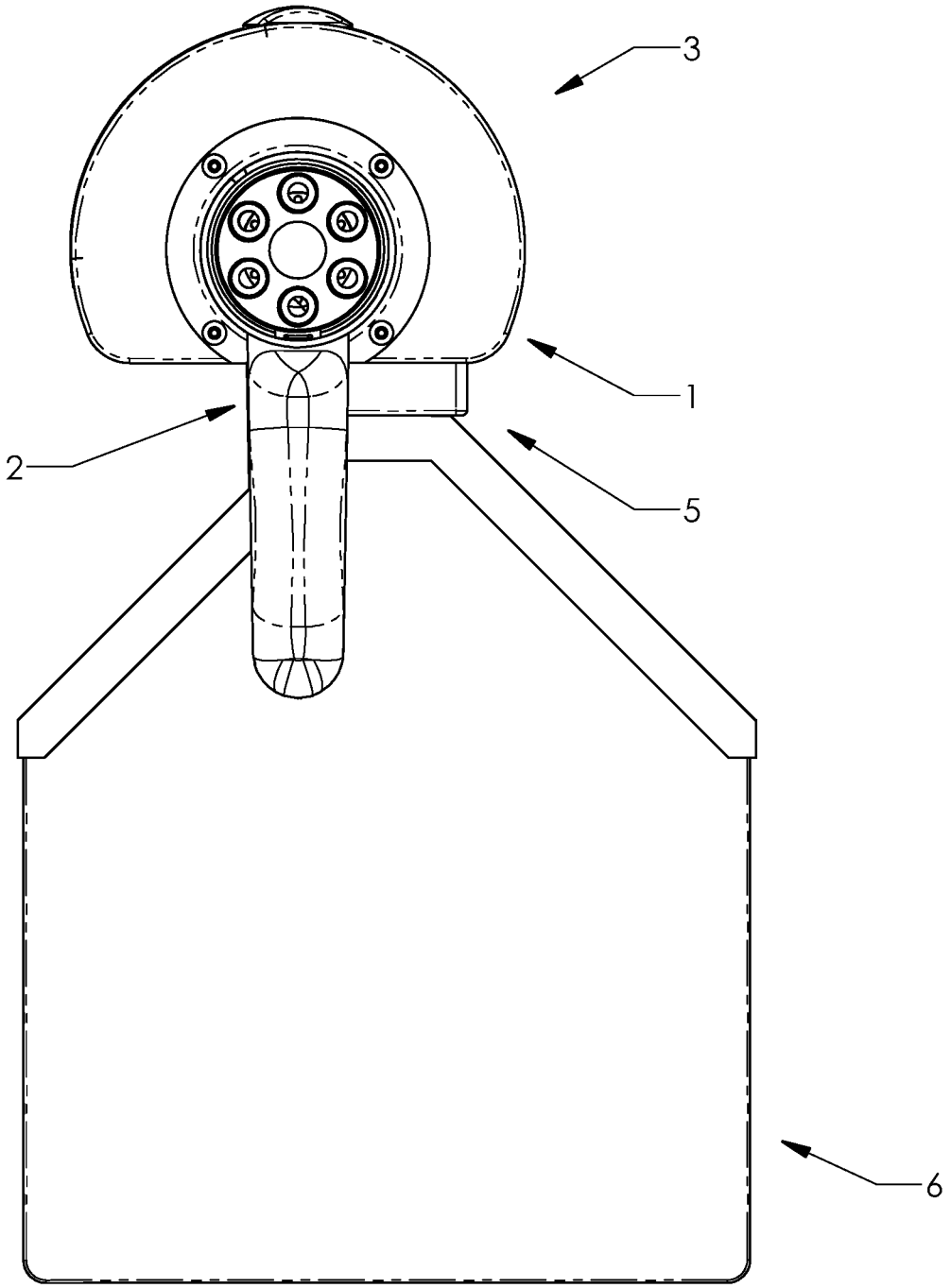
FIG. 6 is a Front view of the Multi-Barrel Split-breech Rapid Fire Gun.
Figure 7:
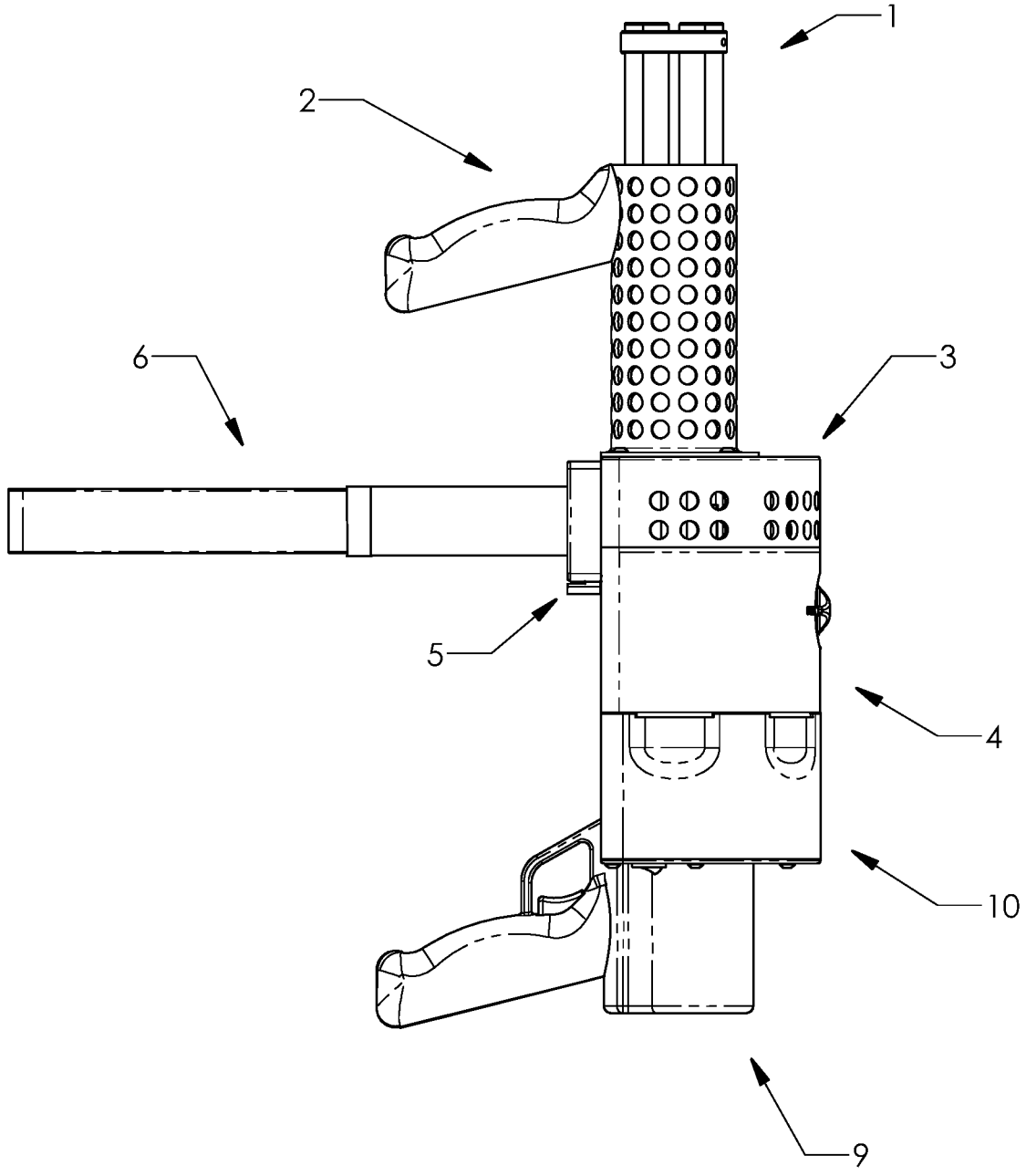
FIG. 7 is a Left view of the Multi-Barrel Split-breech Rapid Fire Gun.
Figure 13A:
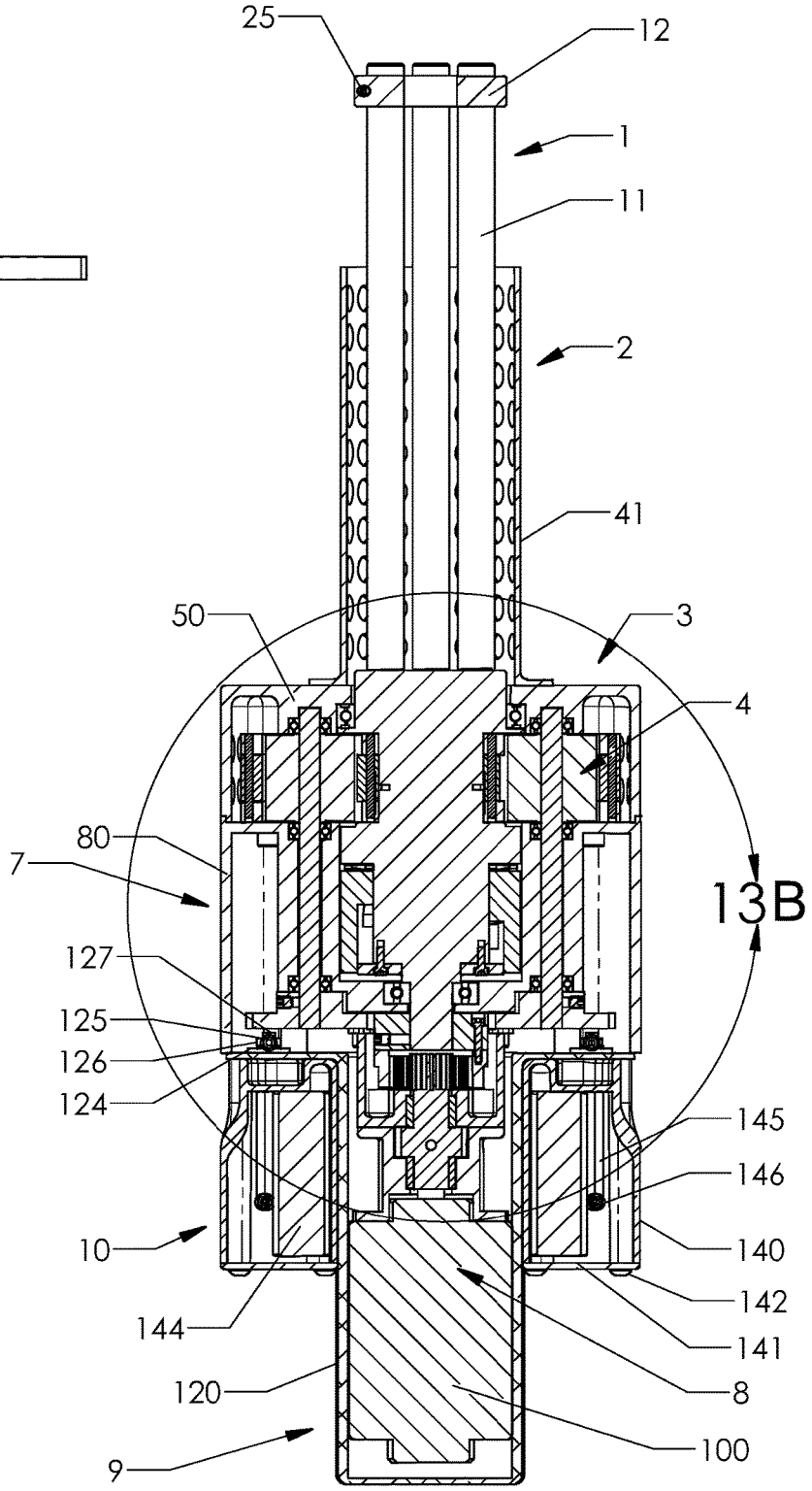
FIG. 13A is a Section view of FIG. 12.
Figure 13B:
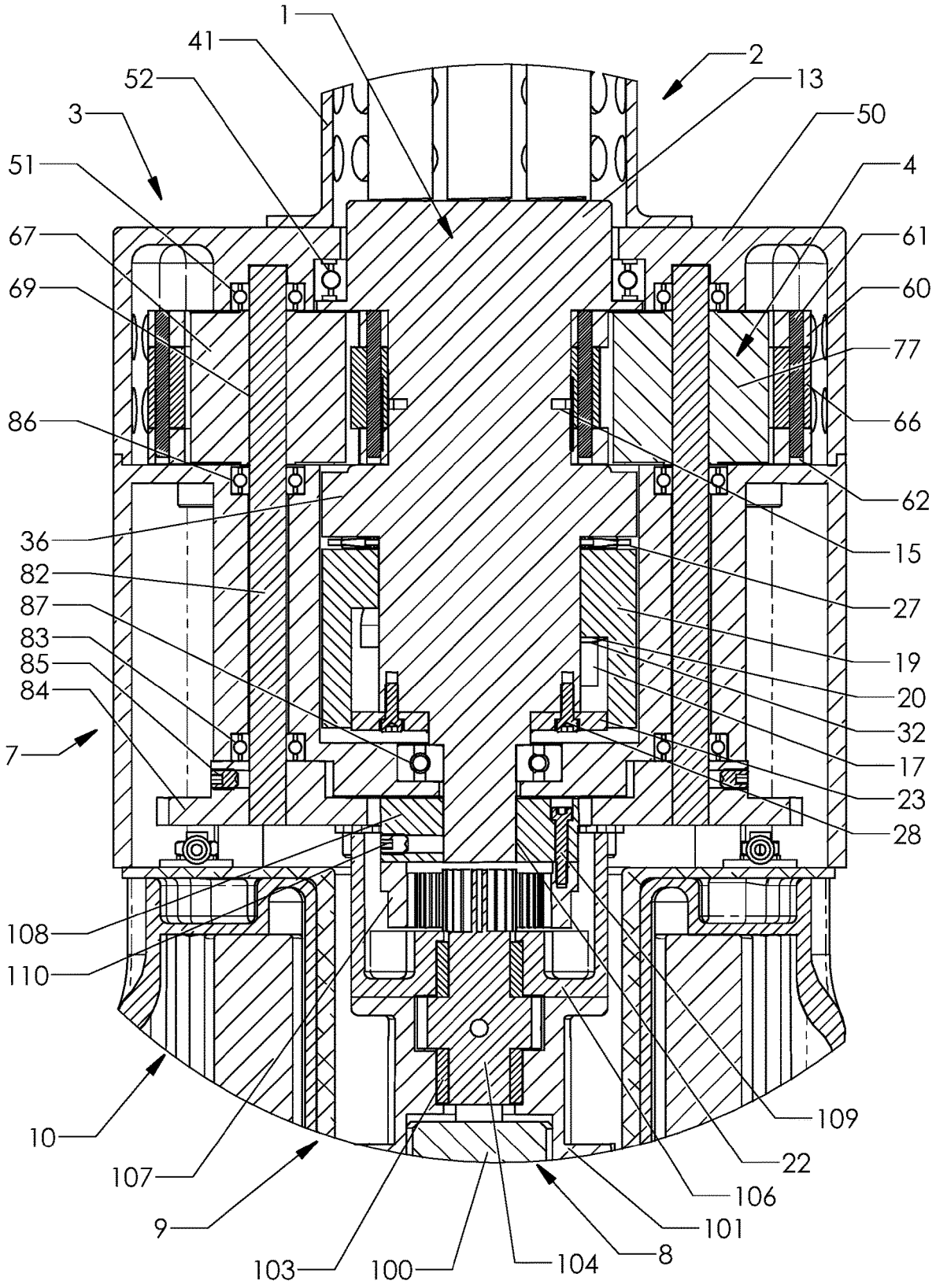
FIG. 13B is a magnified Detail of FIG. 13A.
Figure 15:
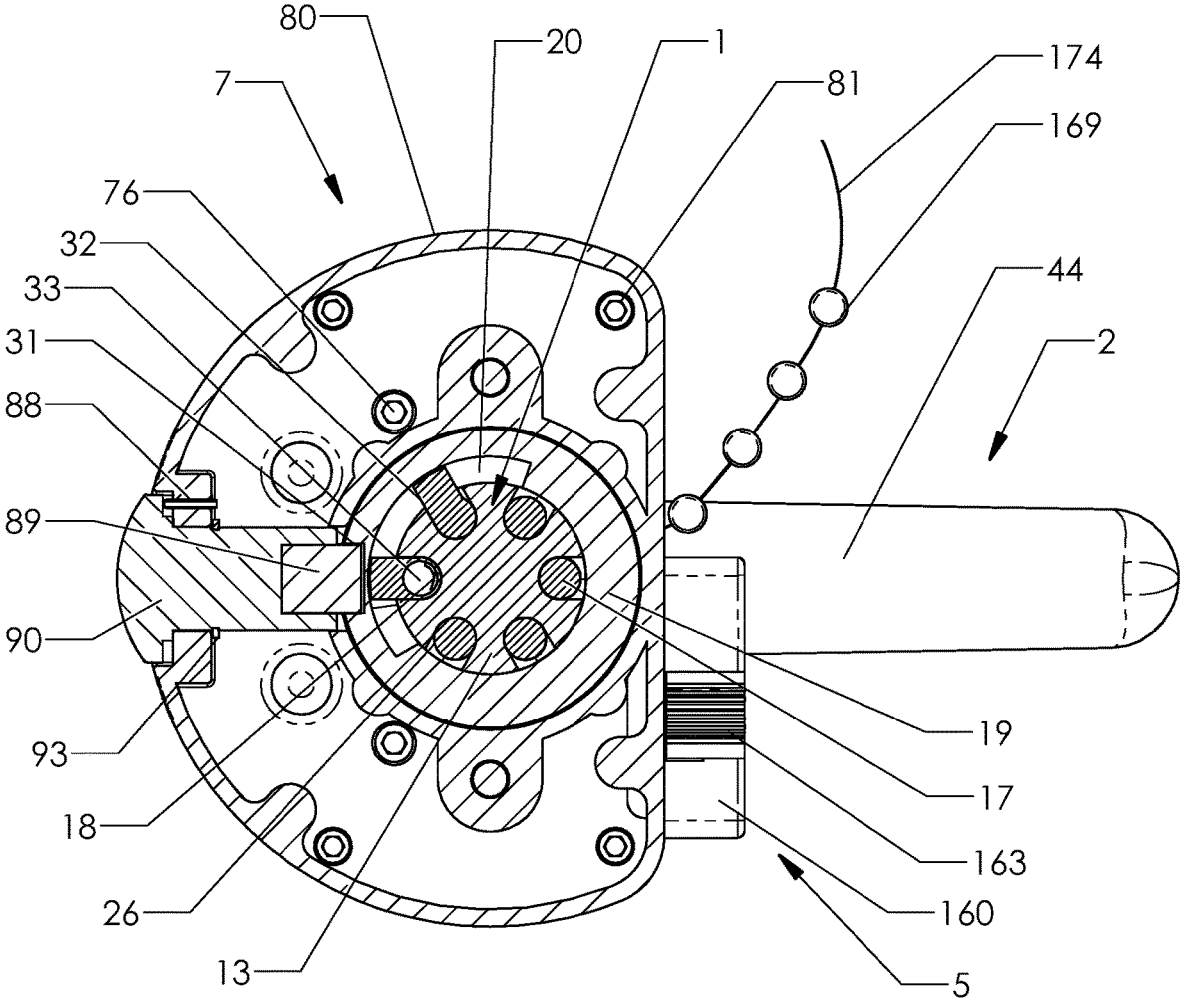
FIG. 15 is a Section view of FIG. 14.
Figure 16:
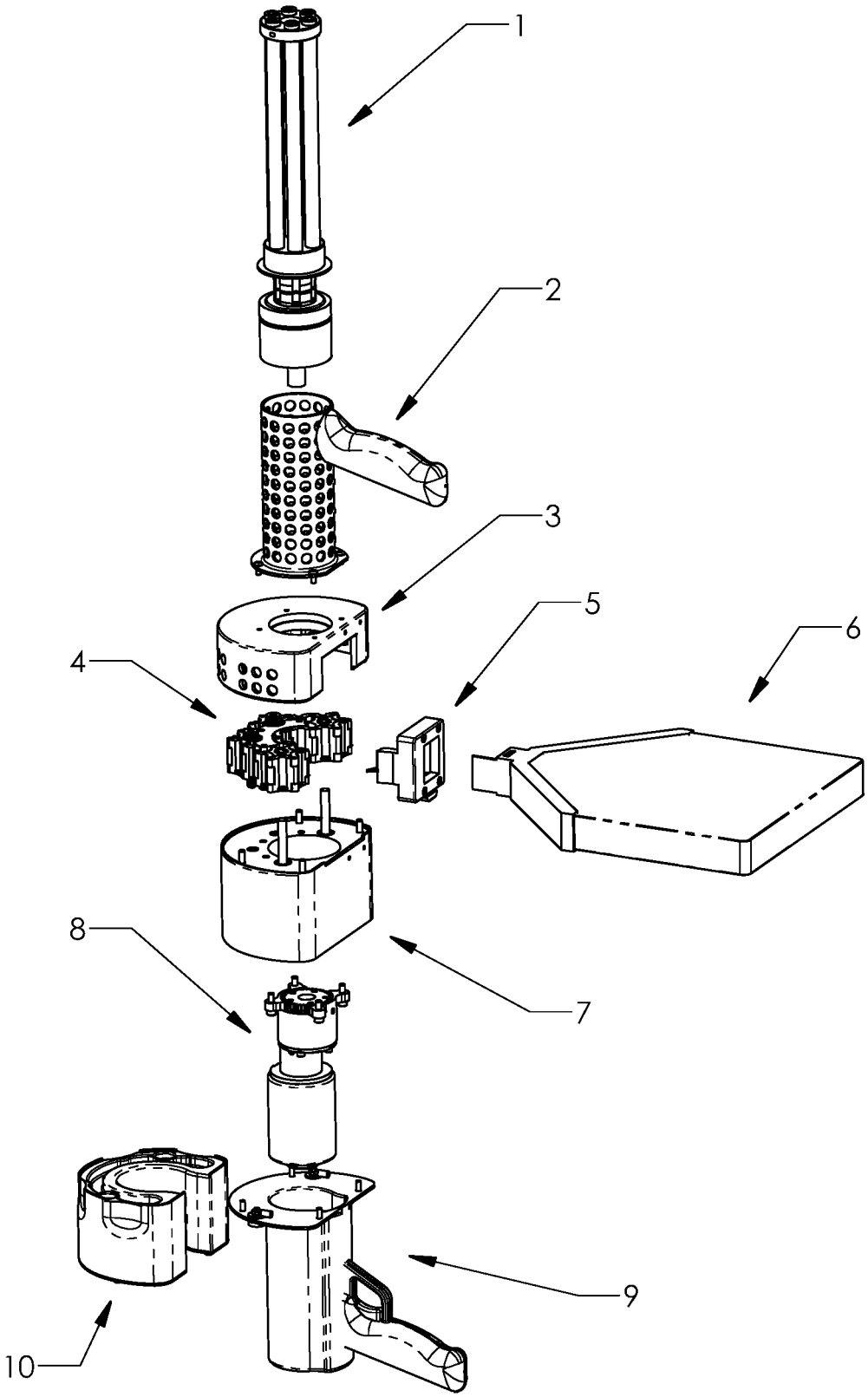
FIG. 16 is an Isometric view of the Multi-Barrel Split-breech Rapid Fire Gun.
Figure 30:
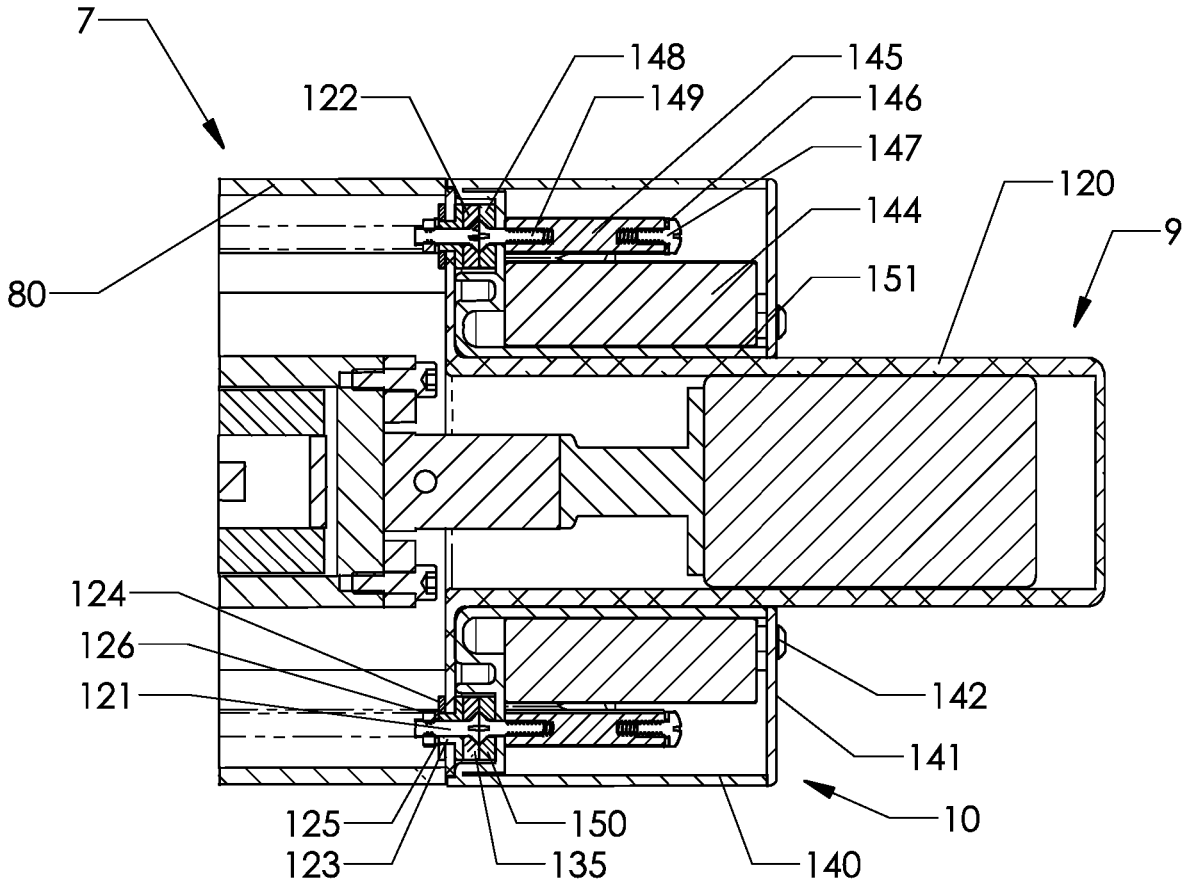
FIG. 30 is a Section view of FIG. 29.

Referring to FIGS. 1, 2, 3, 4, 5, 6, 7 13B, 15, 16 and 30, the multi-barrel split-breech rapid fire gun consists of ten sub-assemblies. These assemblies are the firing assembly 1, the handguard-grip assembly 2, the front housing assembly 3, the chain drive assembly 4, the receiver assembly 5, the wet-magazine assembly 6, the mainframe assembly 7, the motor drive assembly 8, the rear housing and trigger guard assembly 9, and the battery assembly 10. The mainframe assembly 7 is the assembly that forms the structural center of the gun. This assembly houses and supports the firing mechanisms.

Figure 8:
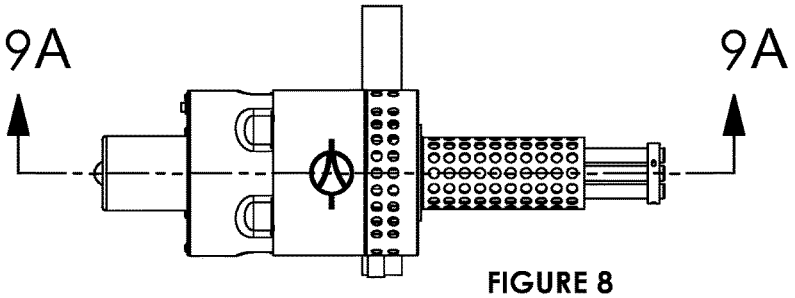
FIG. 8 is another Top view of the Multi-Barrel Split-breech Rapid Fire Gun.
Figure 9A:
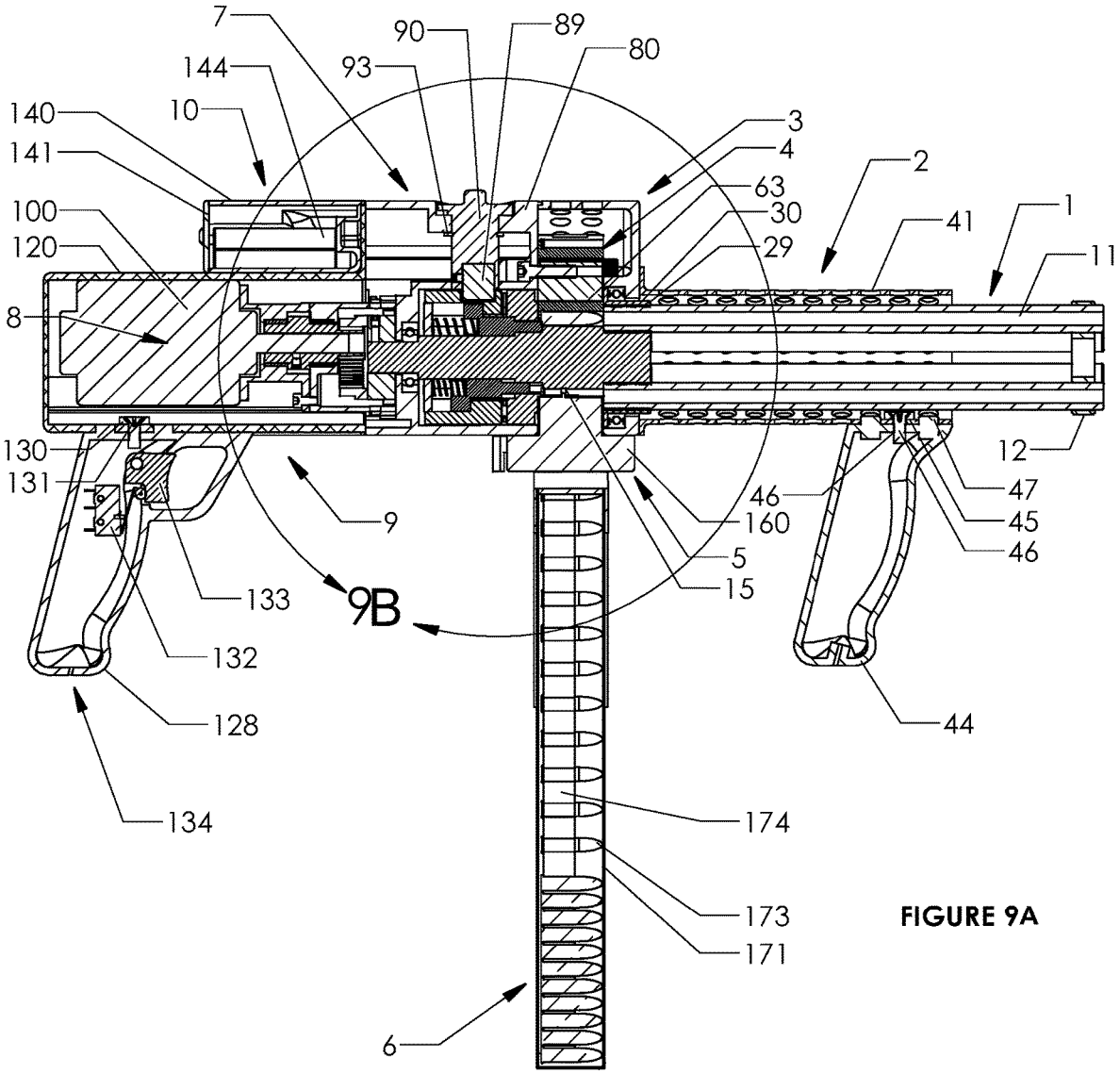
FIG. 9A is a Section view of FIG. 8.
Figure 9B:
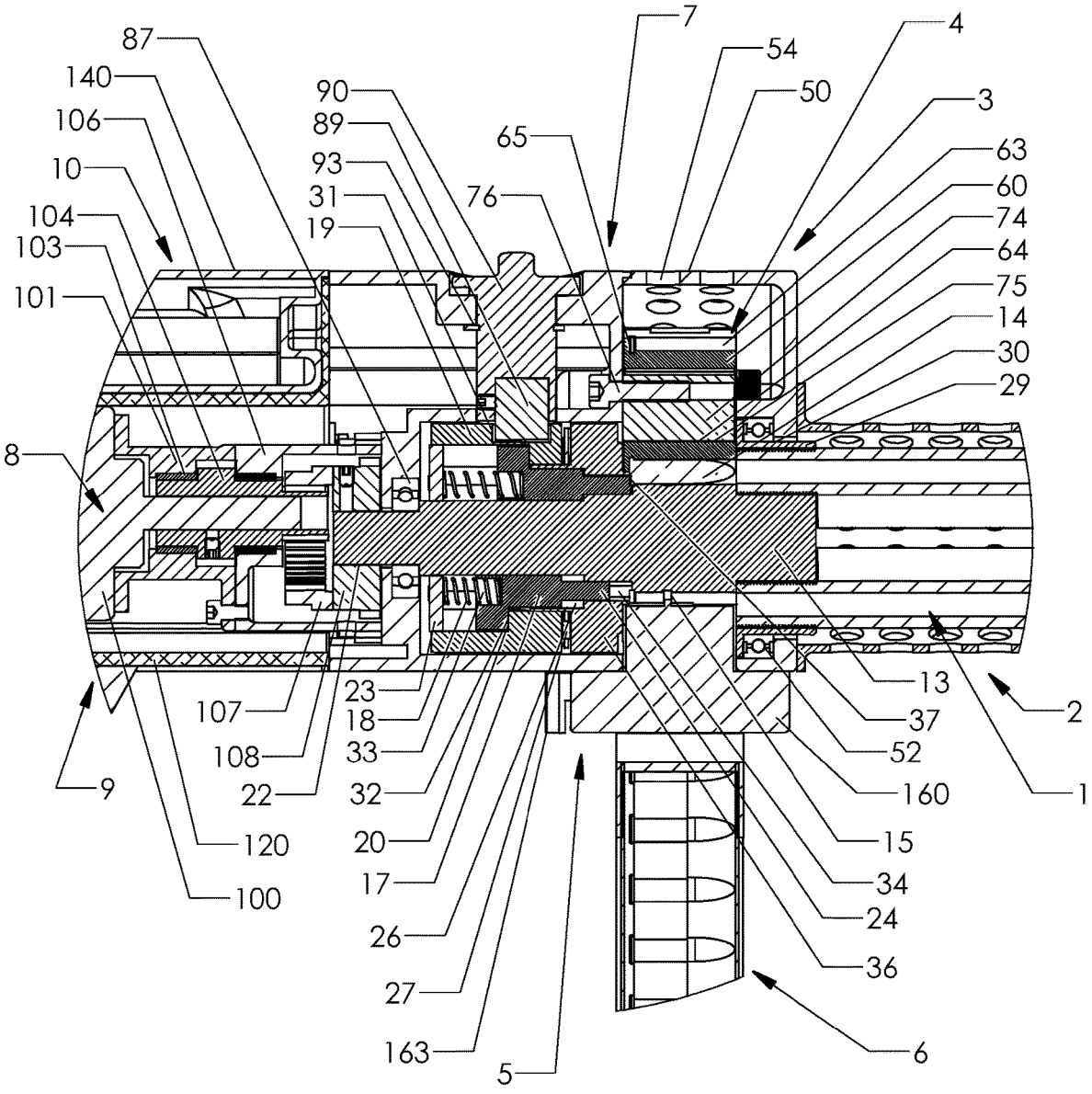
FIG. 9B is a magnified Detail of FIG. 9A.
Figure 11:
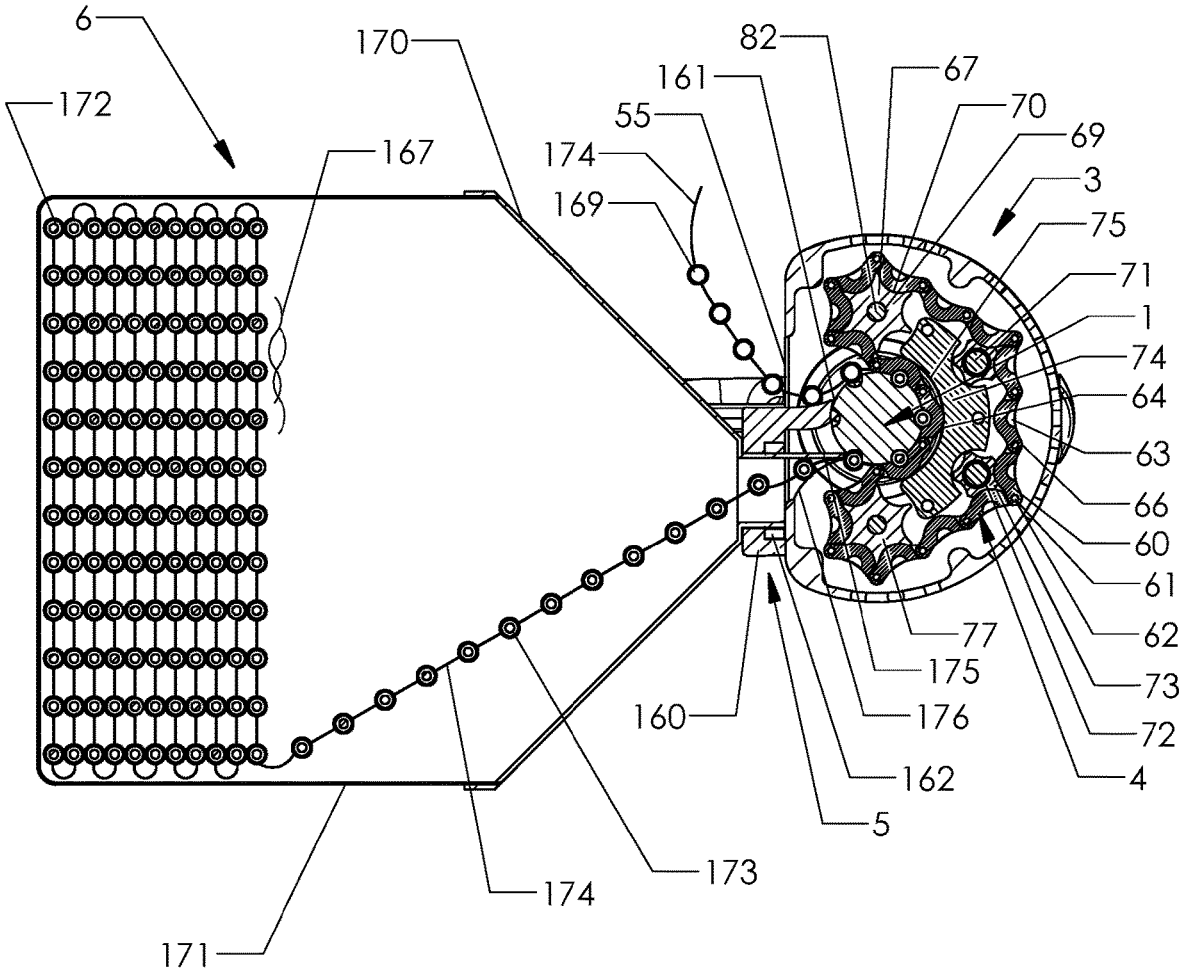
FIG. 11 is a Section view of FIG. 10.
Figure 18:
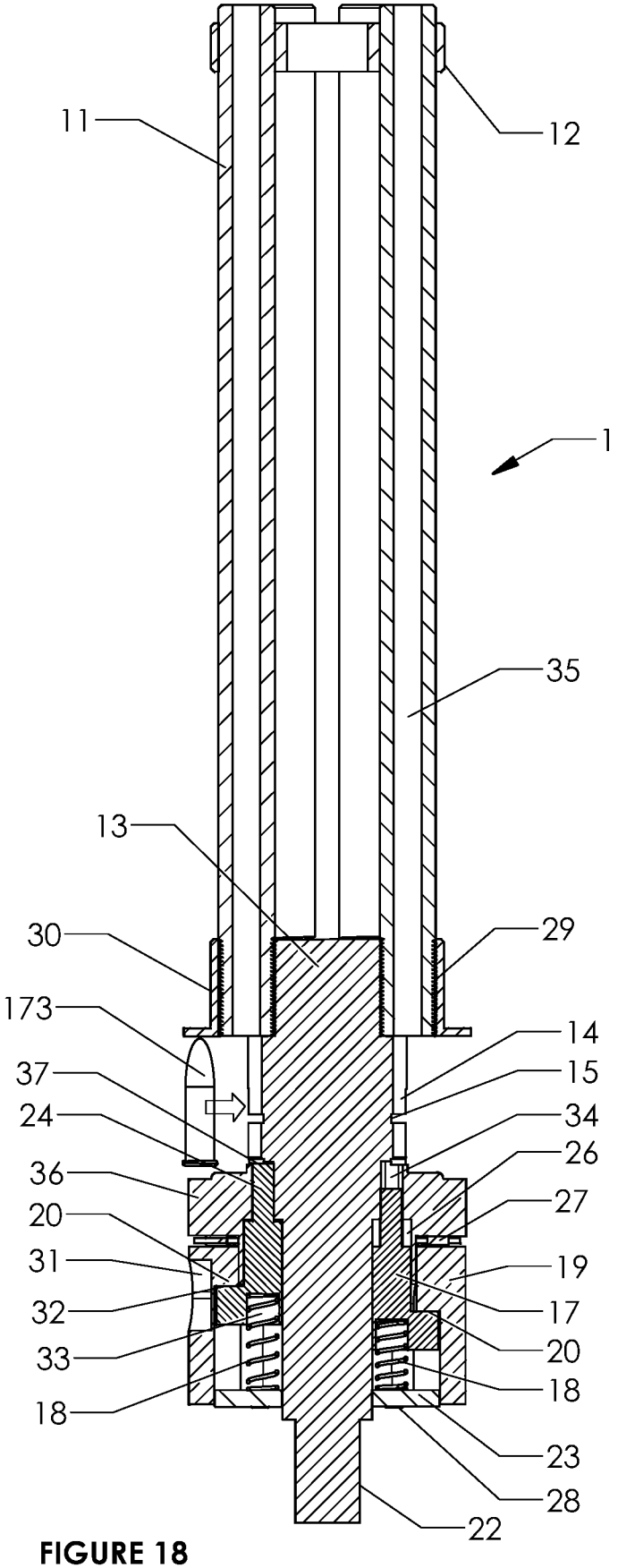
FIG. 18 is a Section view of FIG. 17.
Figures 19A, 19B:
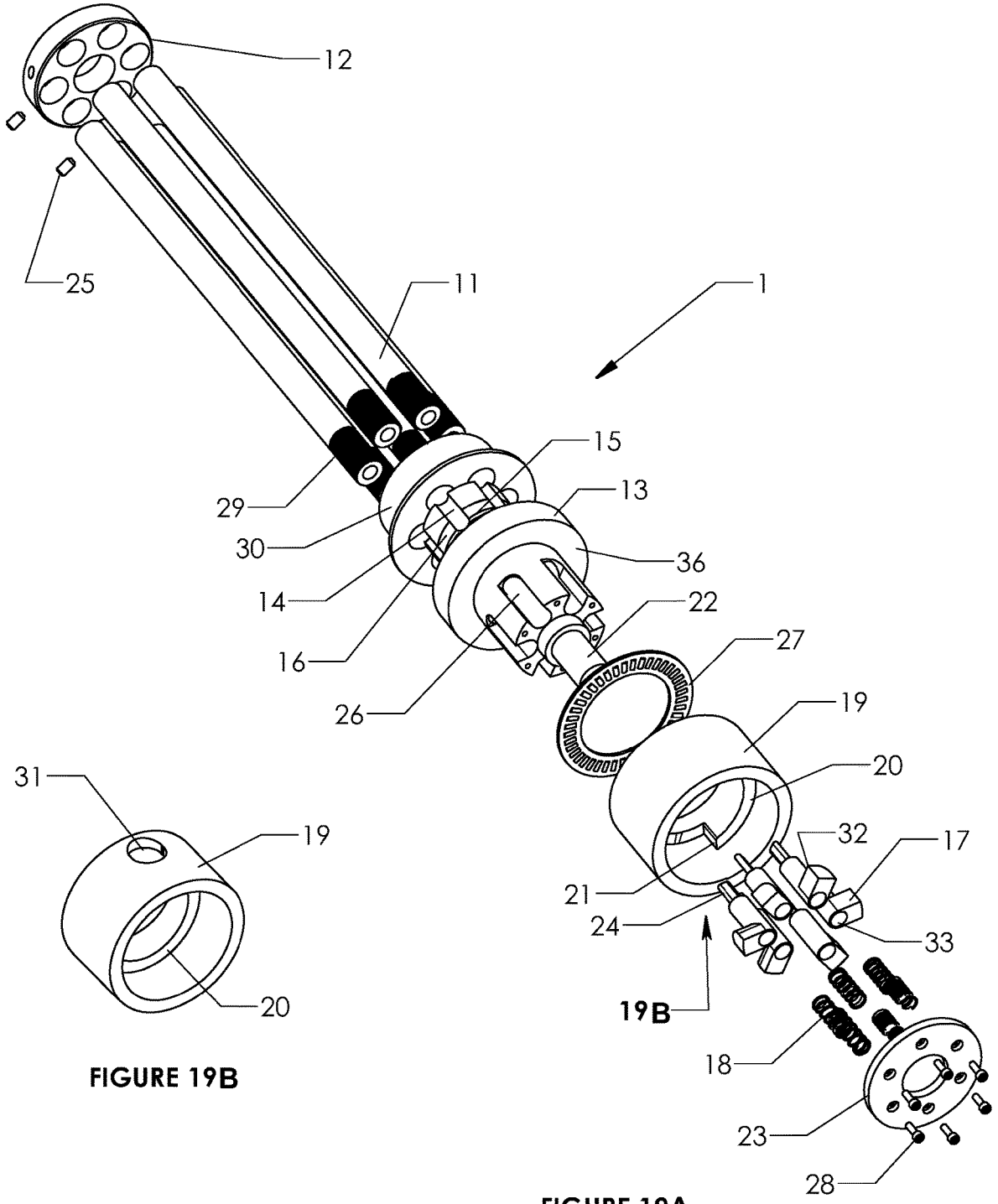
FIG. 19A is an Isometric view of the firing assembly.
FIG. 19B is a Bottom view of item 19B in FIG. 19A.
Figure 20:
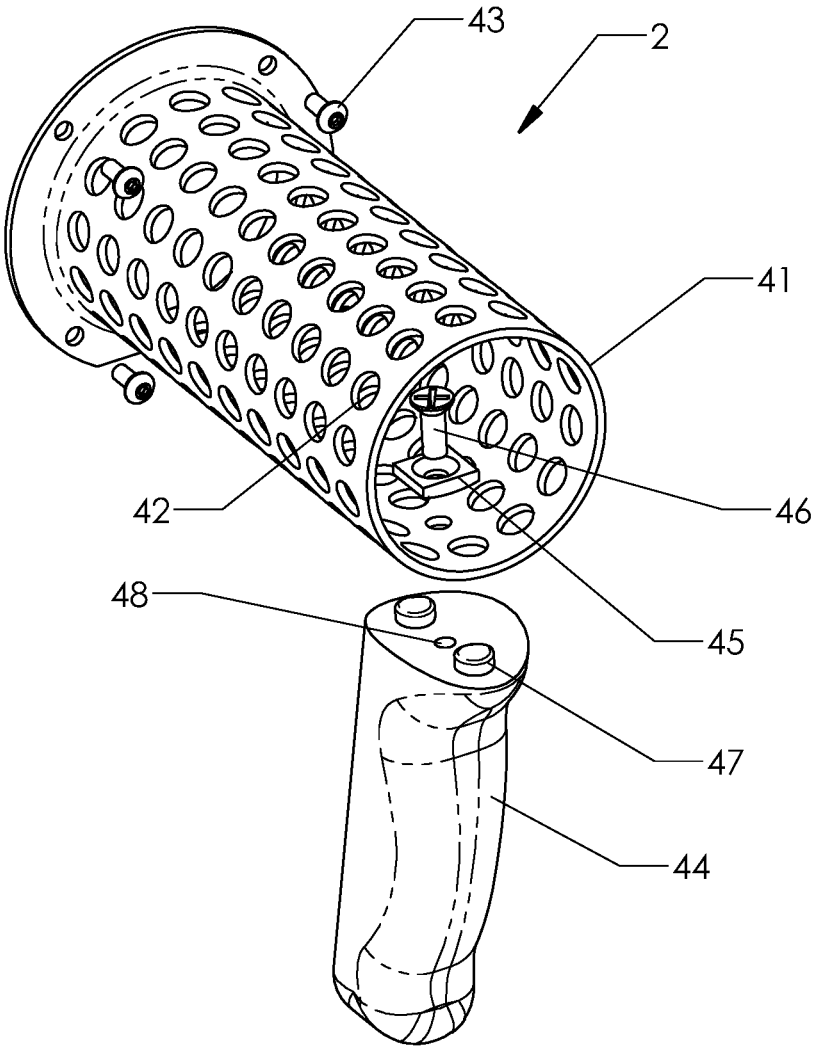
FIG. 20 is an Isometric view of the handguard-grip assembly.
Figure 21:
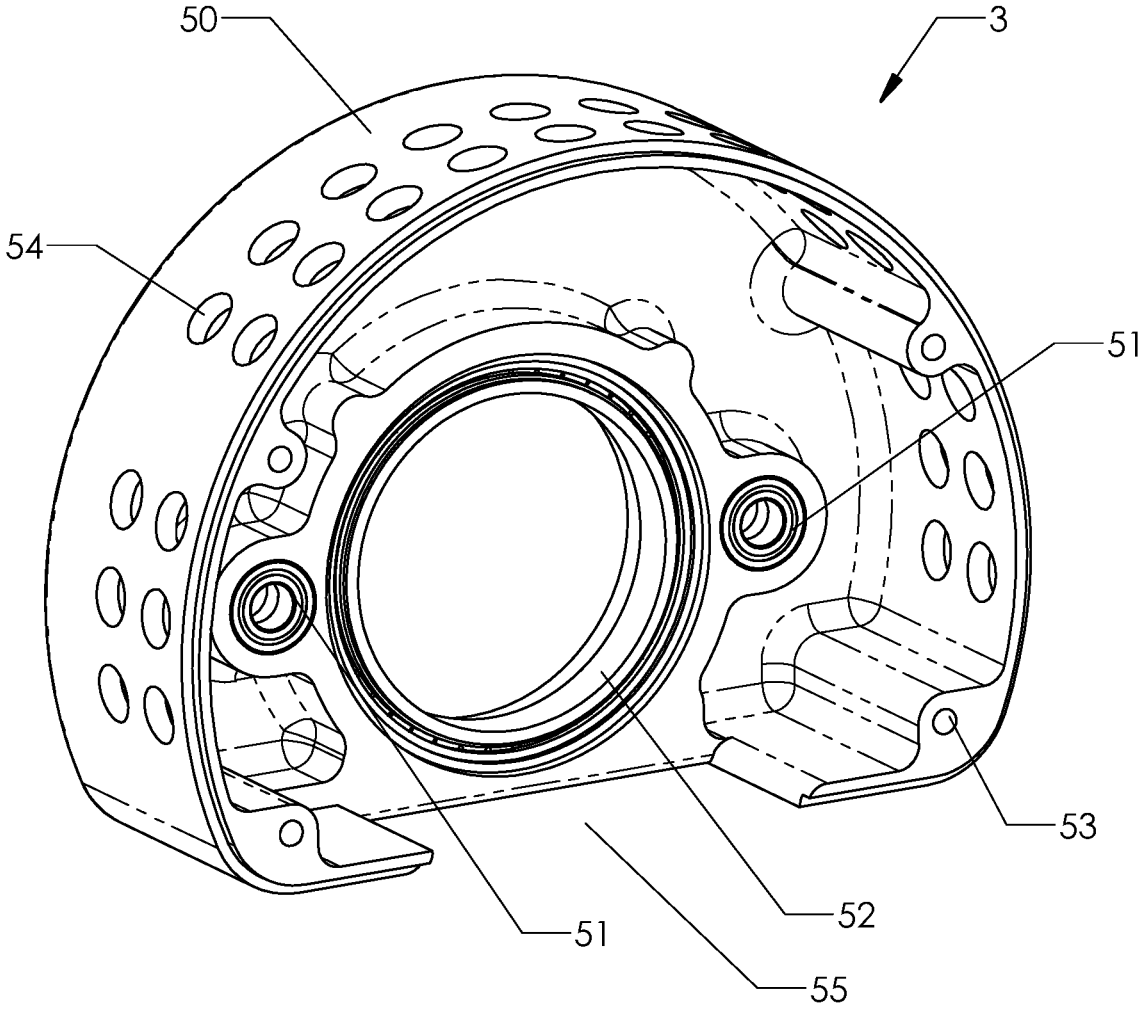
FIG. 21 is an Isometric view of the front housing assembly.
Figure 22:
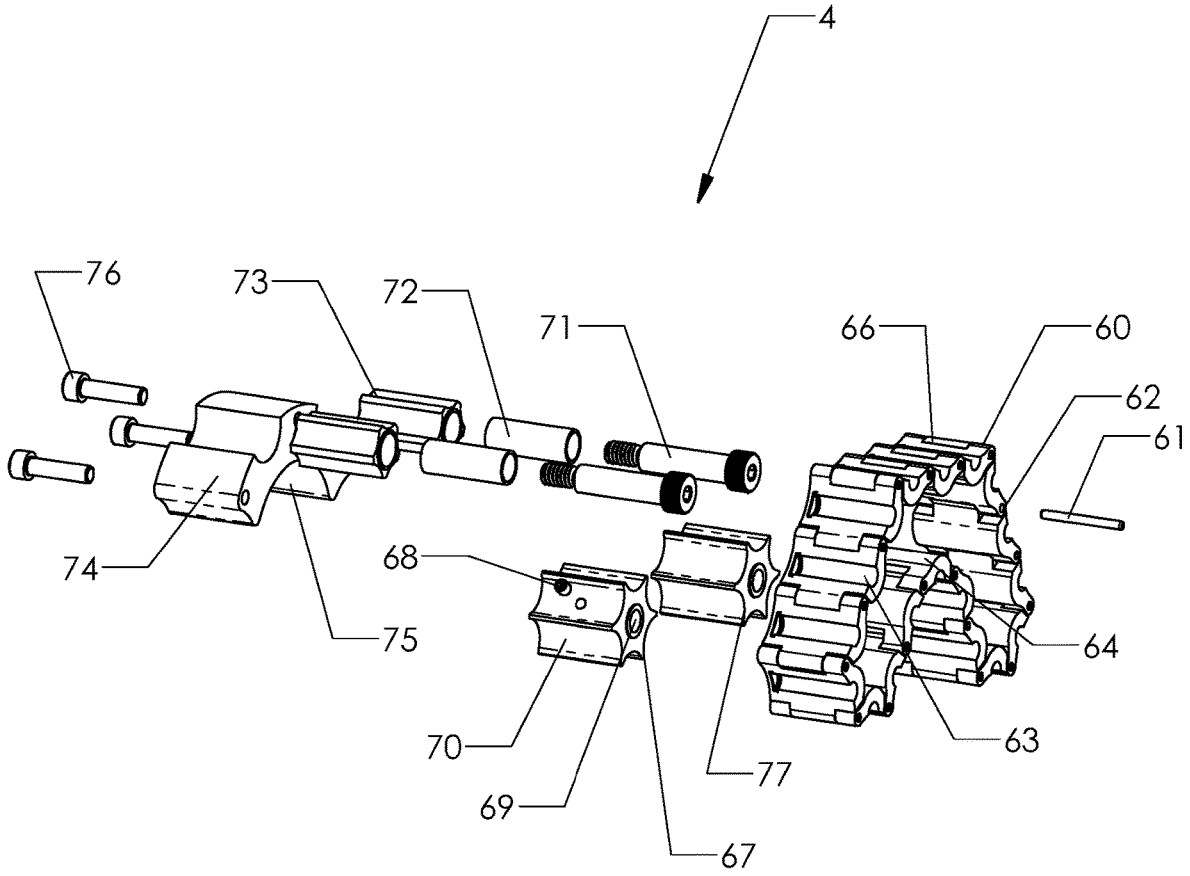
FIG. 22 is an Isometric view of the split-chamber chain assembly.
Figure 23:
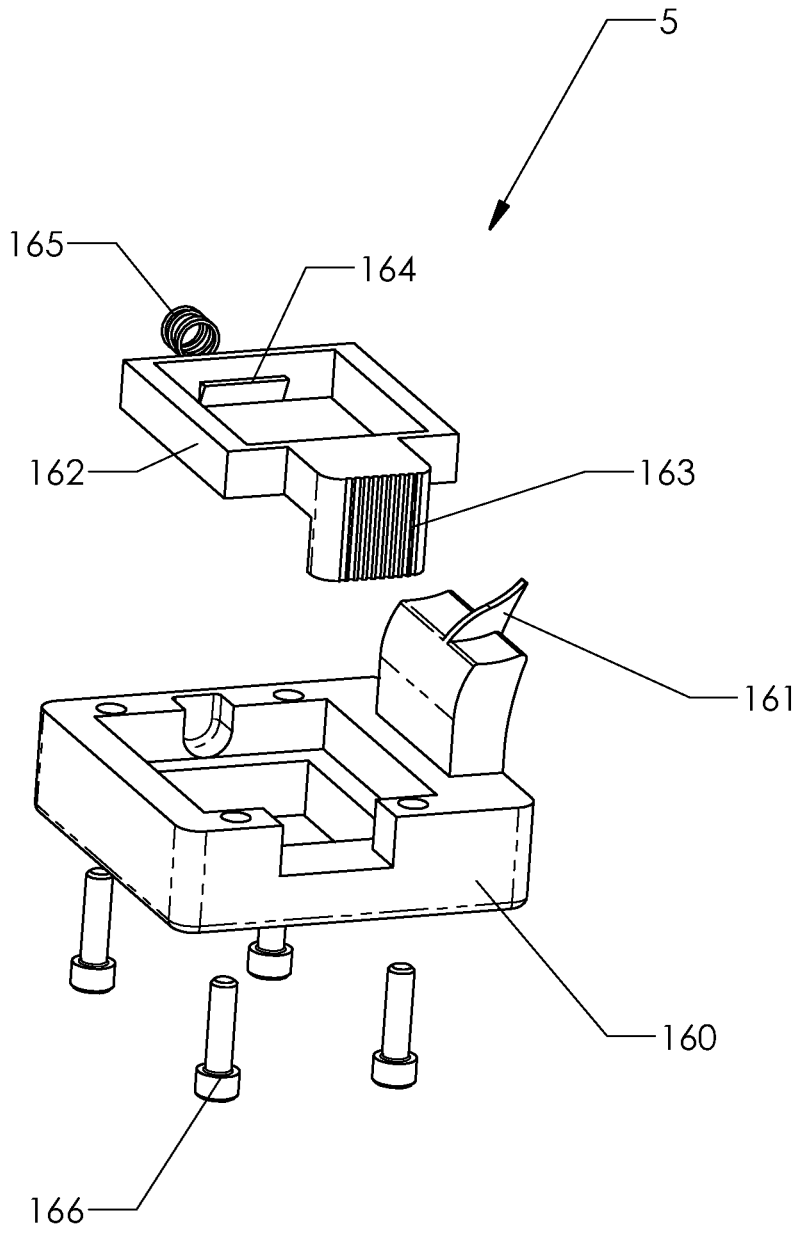
FIG. 23 is an Isometric view of the receiver assembly.
Figure 24:
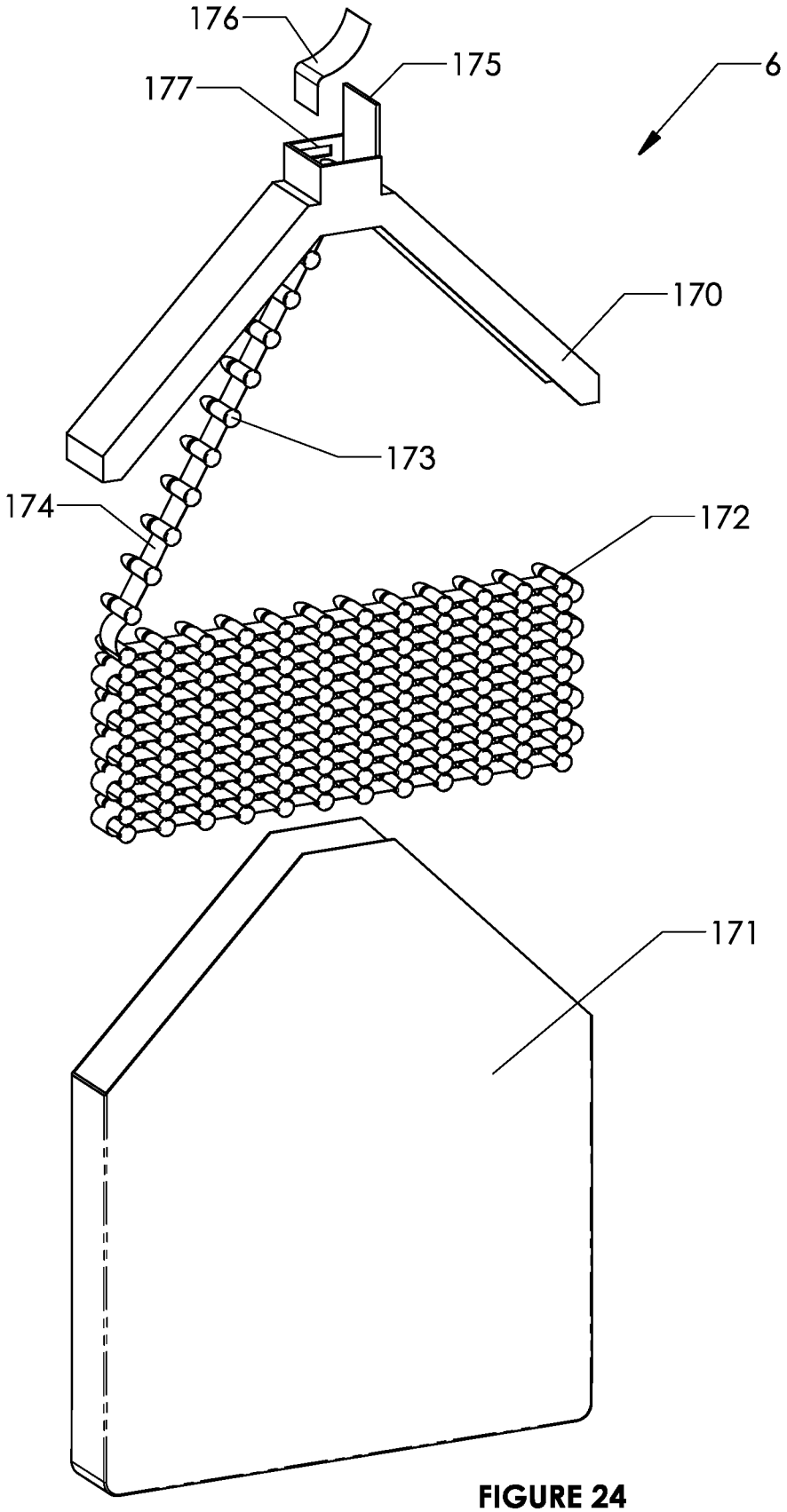
FIG. 24 is an Isometric view of the wet-magazine assembly.
Figure 25:
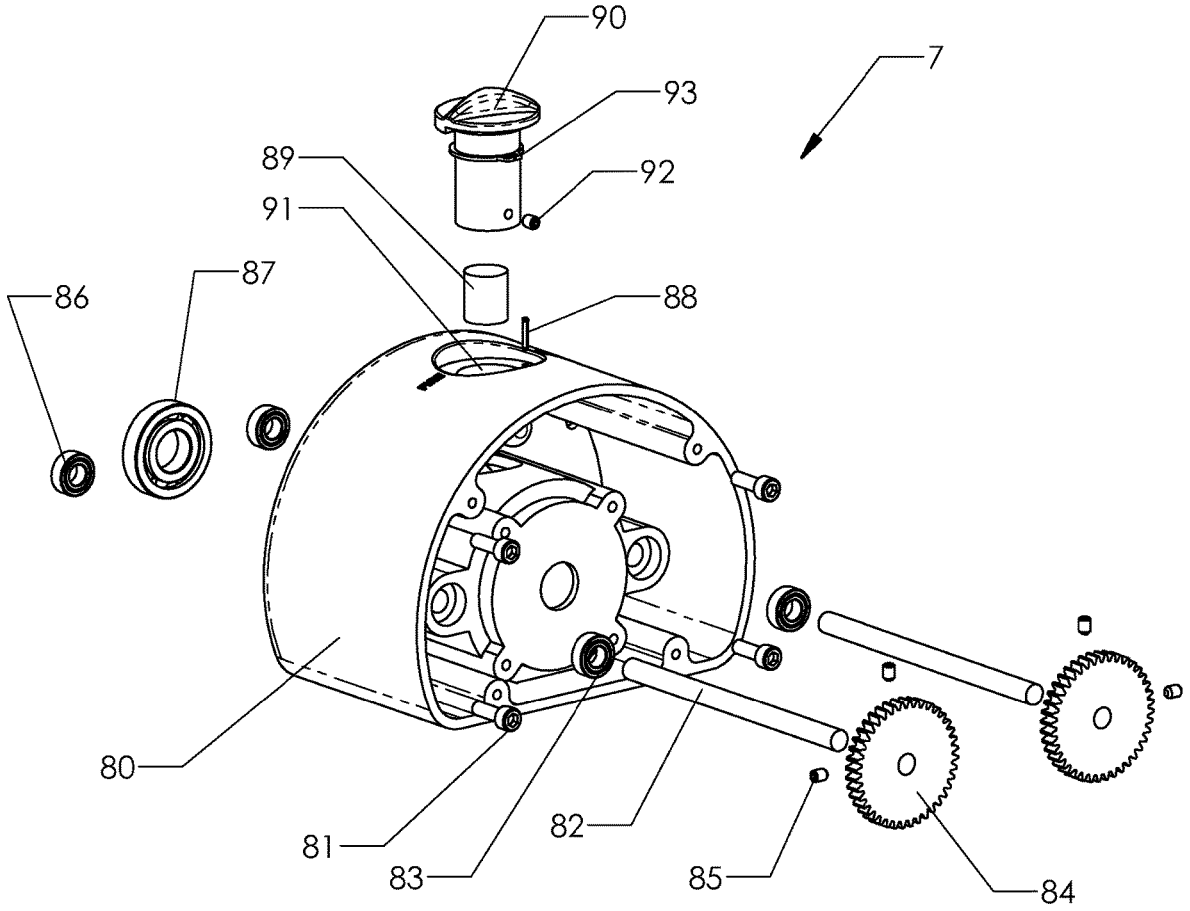
FIG. 25 is an Isometric view of the mainframe assembly.
Figure 26:
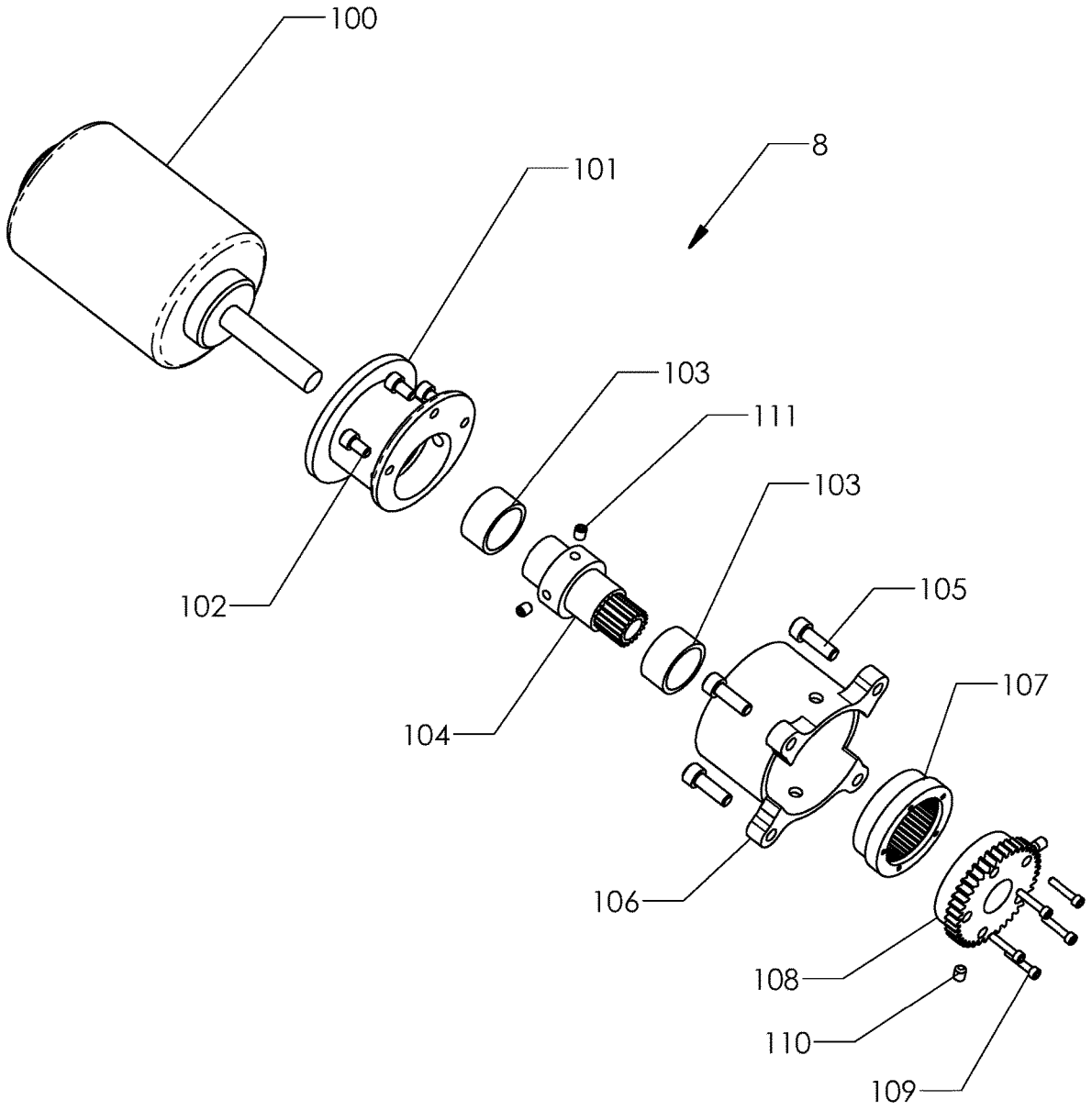
FIG. 26 is an Isometric view of the motor drive assembly.
Figure 27:
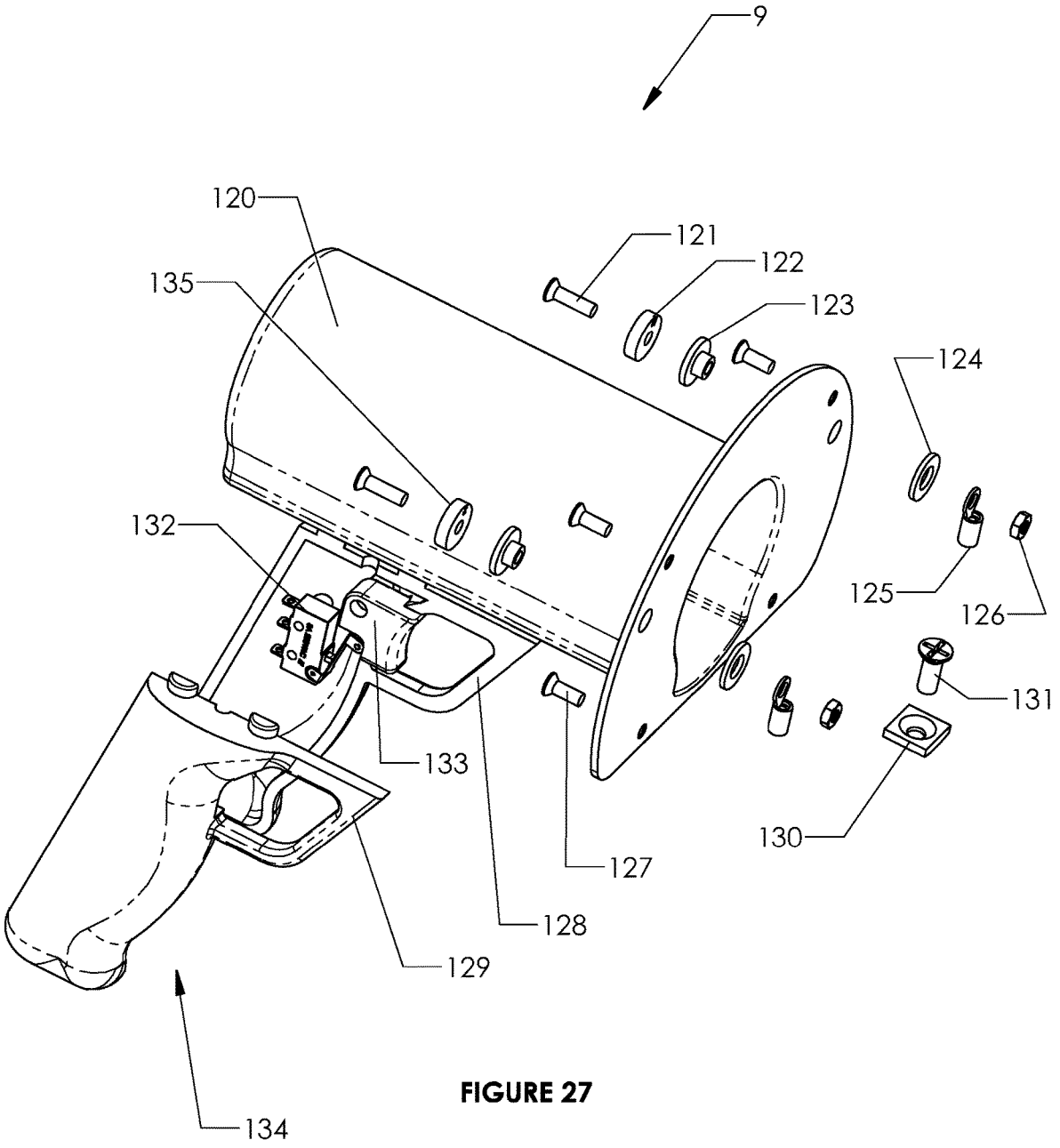
FIG. 27 is an Isometric view of the rear housing and trigger assembly.

Referring to FIGS. 8, 9A, 9B, 11, 13A, 13B, 15, 18 19A, 19B, 20, 21, 22, 23, 24, 25, 26, 27 and 30, the firing assembly 1 consist of a plurality of barrels 11 attached to a barrel hub 13 by means of barrel interface threads 29. A barrel support 12 supports the barrels at the distal end and is secured to the barrels by barrel support set screws 25. The barrel hub 13 is secured by rear shaft 22 constrained by rear barrel hub bearing 87 in the mainframe housing 80, as part of the mainframe assembly 7. The barrel hub 13 is secured in the front by the front shaft 30 constrained by the front barrel hub bearing 52 in front housing 50. The front housing 50, as part of the front housing assembly 3, is connected to the mainframe assembly 7 by a plurality of front housing screws 81 screwed into the front housing screw bosses 53. Front housing 50 contains a plurality of cooling apertures 54 to ventilate and cool the firing mechanism.

Figure 10:
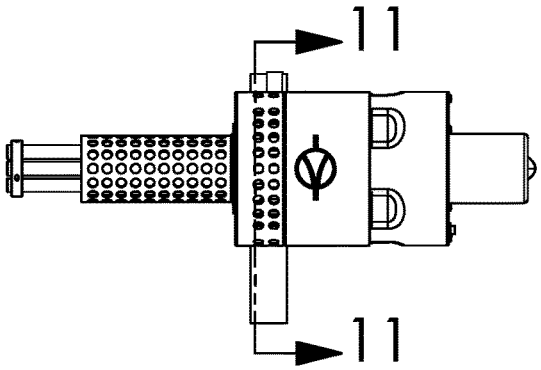
FIG. 10 is another Top view of the Multi-Barrel Split-breech Rapid Fire Gun.
Figure 12:
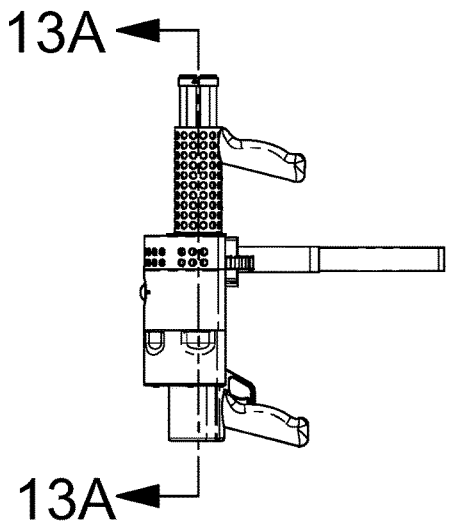
FIG. 12 is another Right view of the Multi-Barrel Split-breech Rapid Fire Gun.

Referring to FIGS. 8, 9A, 9B, 10, 11, 12, 13A, 13B, 18, 22 and 30, the barrel hub 13 includes a plurality of hub half-chamber 14 features concentric with the rifle bore 35 in barrel 11. This half-chamber 14 is half of the split breech. The other half of the split breech is the chain half-chamber 63 feature on the half-chamber chain link 66 as part of the chain drive assembly 4. The plurality of half-chamber chain links 66 is connected to form the half-chamber chain 60 by a plurality of chain link pins 61 installed in the pin aperture 62 on each half-chamber chain link 66. The half-chamber chain 60 path wraps around the barrel hub 13, around ejection drive sprocket 67, around two idler sprockets 73 and around input drive sprocket 77. The idler sprockets 73 rotate on the chain idler shafts 71 attached to the mainframe housing 80 and idler shaft bushings 72.

Referring to FIGS. 13, 21, 22 and 25, the ejection drive sprocket 67 and the input drive sprocket 77 are driven by chain drive shafts 82 passing through drive sprocket aperture 69 and lock onto the shaft by drive sprocket set screw 68. The chain drive shafts 82 are captured on the distal ends by hub front shaft bearing 51 located in front housing 50 and rear chain shaft bearing 83 on the mainframe housing 80 as part of the mainframe assembly 7. A mid-shaft bearing 86 in mainframe housing 80 also supports the chain drive shafts 82. Each chain drive shaft 82 is driven by a chain shaft gear 84 secured to the shaft by shaft gear set screw 85.

Referring to FIGS. 8, 9A, 9B, 10, 11, 12, 13A, 13B, 22, 25 and 26, the chain shaft gears 84 mesh with drive chain gear 108 on the motor drive assembly 8. This meshing arrangement synchronizes the chain half-chamber 63 on the half-chamber chain link 66 with the hub half-chamber 14 on the barrel hub 13 by means of the half-chamber chain link 66 nesting in the sprocket cradle 70 in the chain sprockets.

The barrel hub is driven by motor 100 as part of motor drive assembly 8. In this embodiment, the motor drives a 2:1 ratio gear reduction comprised of a drive gear 104 secured to the motor shaft by means of drive gear set screws 111, driving the driven gear 107 attached to the drive chain gear 108 by means of a plurality of driven gear screws 109. The motor 100 is connected to the drive gear housing 101. The drive gear housing 101 is attached to the driven gear housing 106 by means of a plurality of drive gear housing screws 102. This attachment captures the drive gear 104 and a distal and proximal drive gear bushing 103. The motor drive assembly 8 is secured to the mainframe housing 80 by means of a plurality of driven gear housing screws 105. The drive chain gear 108 is attached to the barrel hub 13 by chamber chain gear set screw 110.

Figure 14:
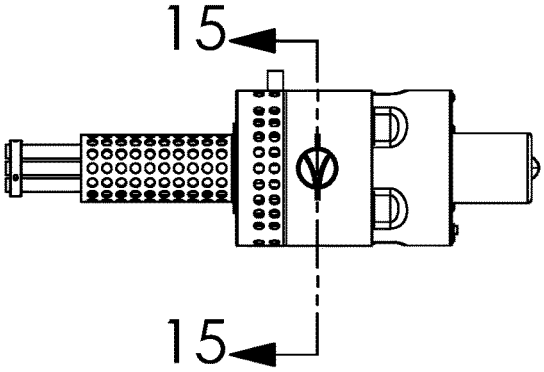
FIG. 14 is another Top view of the Multi-Barrel Split-breech Rapid Fire Gun.

Referring to FIGS. 4, 5, 6, 9A, 9B, 10, 11, 14, 15, 16, 18, 23 and 24, the wet-magazine assembly 6 connects to the receiver assembly 5 by means of magazine retainer pawl 164 on magazine release 162 snapping into the magazine retainer aperture 177 on the magazine lid 170. The magazine release 162 and magazine retainer pawl 164 is biased toward the magazine retainer aperture 177 by means of the magazine release spring 165 located in the receiver body 160. The wet-magazine assembly 6 is released from the gun by pressing the magazine release actuator 163 to slide the magazine retainer pawl 164, on the magazine release 162, out of the magazine retainer aperture 177. The receiver assembly 5 is affixed to the mainframe assembly 7 by a plurality of receiver screws 166.

The wet-magazine assembly 6 is comprised of the magazine lid 170 and the magazine housing 171. The cartridge belt 172 is constructed with a high-temperature polyimide belt 174 that retains the cartridges 173 at a specific spacing to match the hub half-chamber 14 features in the barrel hub 13. The cartridge belt 172 is fan-folded in the magazine housing 171. A loader boss 175, an integral part of the magazine lid 170, and dampener spring 176 also part of the magazine lid 170, positions the first cartridge on cartridge belt 172 directly above and touching the top surface of loader boss 175. This positions the first cartridge 173 to be captured by the half-chamber chain 60 as the barrel hub 13 rotates. The dampener spring 176 also suppresses the inertia of the cartridge belt 172 in high-speed operation. A portion of the unused space in the wet-magazine 6 is filled with a solution 167 of water, propylene glycol and 1% silicone lubricant. This solution 167 is transferred by the cartridge belt 172 cools, lubricates, and prevents corrosion of the firing mechanism and proximal ends of the barrels 11.

Figure 17:
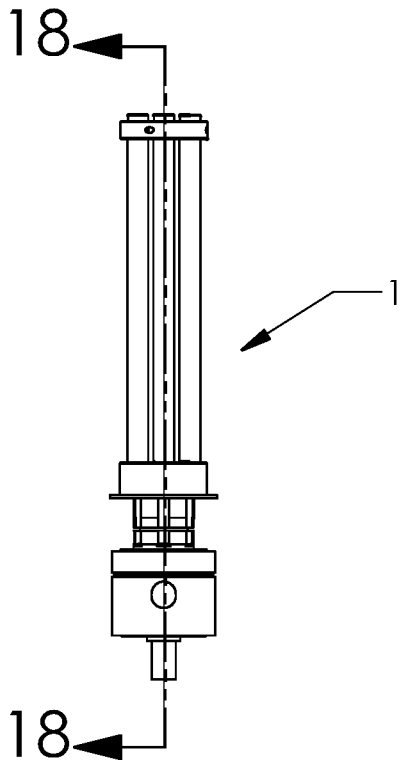
FIG. 17 is a Top view of the firing assembly.

Referring to FIGS. 8, 9A, 9B, 10, 11, 12, 13A, 13B, 14, 15, 16, 17, 18, 19A, 19B, 21, 22, 23, 25 and 30, the firing pin mechanism, an integral part of the firing assembly 1, is comprised of a plurality of firing pins 17, the firing pin cam 19 and thrust bearing 27. The firing pins 17 are captured and slide freely in the firing pin slots 26 in the barrel hub 13. A firing pin spring 18, one for each firing pin 17, are captured on the proximal end by spring cavity 33 in firing pin 17. The springs are captured on the distal end by the spring retainer plate 23. The spring retainer plate 23 is secured to the barrel hub 13 by a plurality of spring retainer screws 28.

The firing pin cam 19 is held in a static non-rotating position by the safety actuator 90 and the eccentric safety shaft 89. The eccentric safety shaft 89 is secured to the safety actuator 90 by eccentric shaft set screw 92. The safety actuator 90 is retained in the safety actuator aperture 91 by spring clip 93 in the mainframe housing 80 as part of mainframe assembly 7. Safety actuator 90 is limited in rotation and stopped at fire and safety positions by safety stop pin 88 in mainframe housing 80. The safety actuator 90 is placed, by the user, in either the fire position or the safety position. In the fire position, the eccentric safety shaft 89 is located and constrained by the cam retainer well 31 on firing pin cam 19 fixing the cam relative to the mainframe. As the barrel hub 13 is rotated along with the firing pins 17, a cam follower 32 on firing pin 17 contacts and follows the cam ramp 20 on firing pin cam 19. As the barrel hub 13 rotates inside of the firing pin cam 19, pressure is increased by loading the firing pin springs 18. This pressure is translated through the thrust bearing 27 to cam stop 36 on barrel hub 13. As each firing pin 17 climbs the cam ramp 20, bias is increased on each firing pin spring 18 in turn. As the barrel hub 13 continues to rotate, the lead firing pin cam follower 32 reaches the sear face 21 on cam ramp 20. This is the firing position 37 defined by the point in the barrel hub 13 revolution where the half-chamber chain link 66 and hub half-chamber 14 are concentric and fully encase a cartridge. This firing position 37 is synchronized by the chain shaft gears 84 meshing with drive chain gear 108 as describe earlier. This position of the sear face 21 on cam ramp 20 allows the firing pin 17 and striker 24, by means of the cam loaded bias of the firing pin spring 18, to travel rapidly through the striker aperture 34 in barrel hub 13. The striker 24 then hits the cartridge primer with enough inertia to set off the primer and fire the bullet. All the firing pins follow this action in turn. In this embodiment, six bullets are fired per revolution of the barrel hub.

As the empty cartridges 169 are rotated around the barrel hub 13, the half-chamber chain link 66 separates from the barrel hub 13 and is taken up by the ejection drive sprocket 67 on the exit side. Ejector slot 15 in the barrel hub 13 and ejection pawl 161, part of the receiver assembly 5, strips the empty cartridges and cartridge belt 172 off the barrel hub 13 to be routed through the exit aperture 55 in the front housing 50 and out of the gun.

In the safety position of the safety actuator 90, the eccentric safety shaft 89 pushes against the retainer well 31 on firing pin cam 19 to slide the firing pin cam 19 back away from the normal firing position where the striker 24 cannot contact the cartridge.

When the bullet is fired, maximum pressure caused by the propellant is exerted on the split-breech half-chamber chain link 66 and hub half-chamber 14 on barrel hub 13. The half-chamber chain link 66 will tend to blow outward, away from the barrel hub 13. A pressure fence 74 is attached to the mainframe housing 80, and held concentric to the barrel hub 13 by means of a plurality of retaining screws 76. Contact of the link pressure face 64 on half-chamber chain link 66 and the stop surface 75 on the pressure fence 74 constrains this movement.

In normal operation, as the barrel hub 13 rotates, the high-temperature polyimide belt 174 on the cartridge belt 172 becomes trapped between the half-chamber chain link 66 and the barrel hub 13. A belt relief 16 in barrel hub 13 allows for the thickness on the high-temperature polyimide belt 174.

Referring to FIGS. 5, 7, 8, 9A, 9B, 12, 13A, 16 and 27, the motor housing and trigger guard assembly 9 connects to the mainframe assembly 7 by a plurality of motor housing screws 127. The motor housing 120 protects the motor drive assembly 8 and provides a mounting point for the rear handle 134. The rear handle 134 is composed of the left trigger grip 128 and the right trigger grip 129. The rear handle 134 is attached to the motor housing 120 by trigger grip retainer 130 and trigger grip retainer screw 131. The left trigger grip 128 and the right trigger grip 129 capture the trigger lever 133 and power switch 132. In this embodiment the trigger mechanism is shown as the trigger lever 133 pressing against the power switch 132 to power the motor drive assembly 8 and fire the gun at the maximum motor speed. In other embodiments (not shown) the power switch 132 can be replaced with an electronic speed control module, such as used in a power drill, that will allow the gun to have a variable firing rate.

Figure 28:
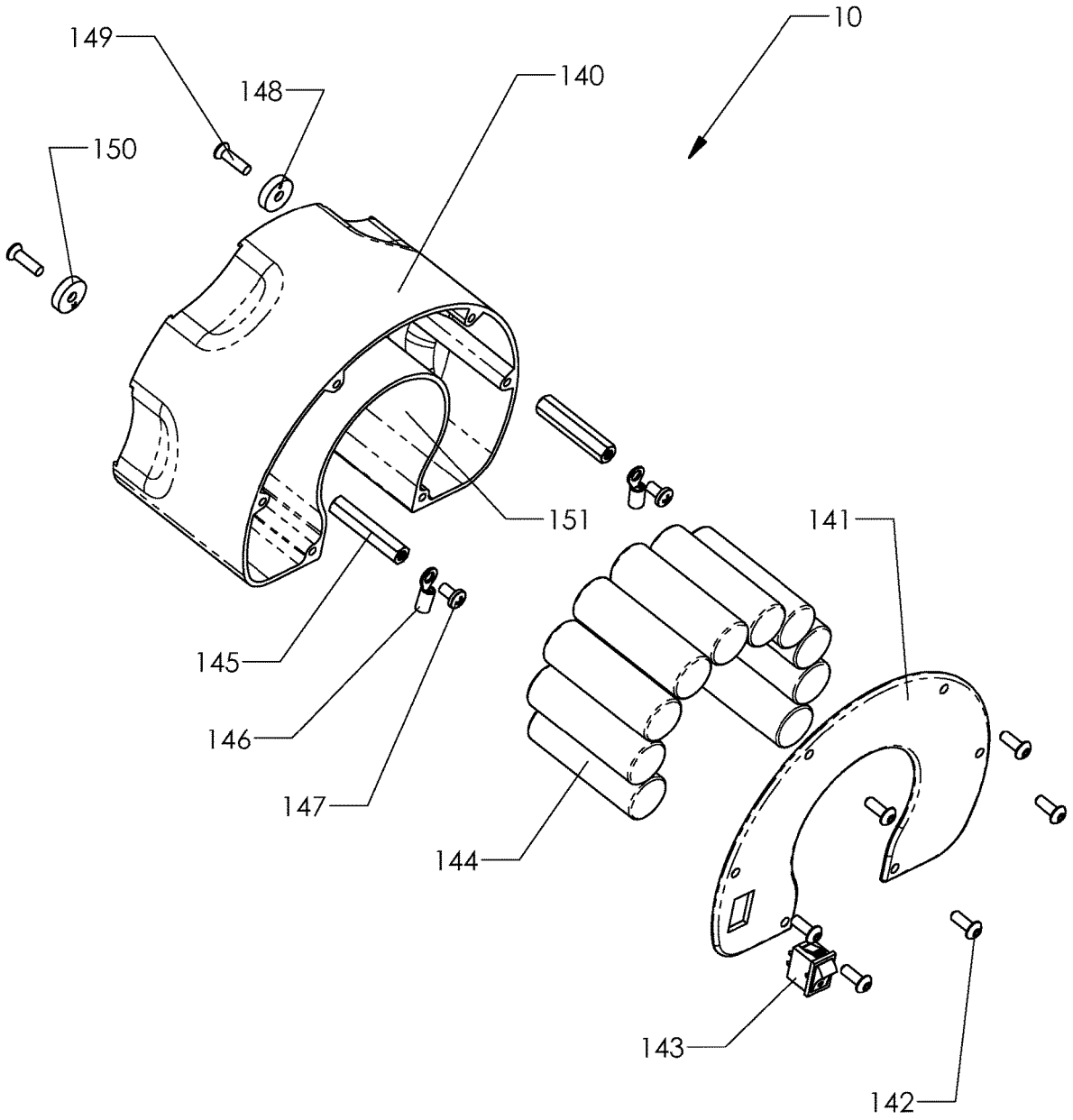
FIG. 28 is an Isometric view of the battery assembly.
Figure 29:
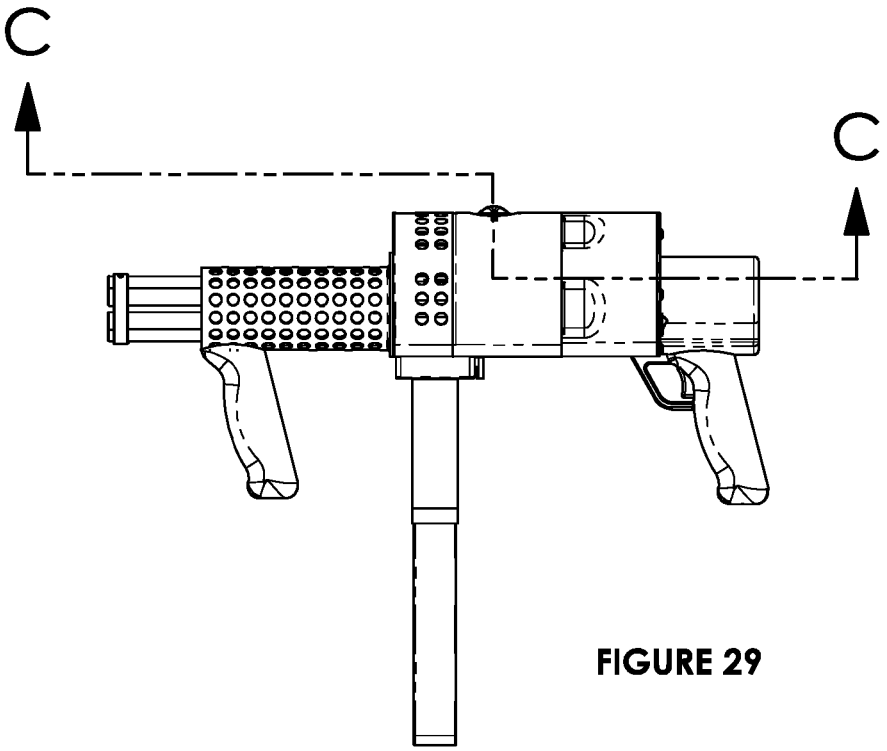
FIG. 29 is another Left side view of the of the Multi-Barrel Split-breech Rapid Fire Gun.

Referring to FIGS. 5, 7, 8, 9A, 9B, 12, 13A, 13B, 16, 27, 28, 29 and 30, the battery assembly 10 consist of a plastic non-conductive battery housing 140, a battery housing cover 141 and a plurality of rechargeable batteries 144. The battery housing cover 141 is attached to the battery housing 140 by means of a plurality of cover screws 142. A battery power switch 143 snaps into the battery housing cover 141. This switch 143 switches battery assembly 10 ON or OFF. Power to the gun is connected by means of a positive magnetic contact 148 and a negative magnetic contact 150. These contacts are secured to the battery housing 140 by a magnet screw 149 screwing into a contact stand-off 145, one for each contact, located in the battery housing 140. The batteries are connected to the contact stand-offs 145 by means of an electrical ring terminal 146 and a terminal screw 147. The battery assembly 10 is slid onto the rear housing assembly 9 through the battery assembly aperture 151 and magnetically locked to the rear housing assembly 9 by a corresponding positive magnet 122 and negative magnet 135 on the motor housing 120.

Positive magnet 122 and negative magnet 135 are electrically isolated from the metal motor housing 120 by means of a plastic shoulder washer 123 and a plastic washer 124. The magnets are connected to the motor 100 by motor terminal screw 121, motor ring terminal 125 and nut 126.

Referring to FIGS. 1, 2, 3, 4, 6, 7, 9A, 9B, 13A, 13B, 15, 16, 18, 20 and 21, the handguard-grip assembly 2 consists of a handguard 41 and a front grip 44. The handguard-grip assembly 2 attaches to the front housing assembly 3 by means of a plurality of handguard screws 43. The front grip 44 is attached to the handguard 41 by a grip retainer 45 and a grip retainer screw 46 screwing into the screw aperture 48 on front grip 44. Handguard 41 includes a plurality of cooling apertures 42 to cool barrel 11 on firing assembly 1. Grip alignment pins 47 on front grip 44 nest into the cooling apertures 42 as an anti-rotation device.

PARTS LIST 1 firing assembly
2 handguard-grip assembly
3 front housing assembly
4 chain drive assembly
5 receiver assembly
6 wet-magazine assembly
7 mainframe assembly
8 motor drive assembly
9 rear housing and trigger guard assembly
10 battery assembly
11 barrel
12 barrel support
13 barrel hub
14 hub half-chamber
15 ejector slot
16 belt relief
17 firing pin
18 firing pin spring
19 firing pin cam
20 cam ramp
21 sear face
22 hub rear shaft
23 spring retainer plate
24 striker
25 barrel support set screw
26 firing pin slot
27 thrust bearing
28 spring retainer screw
29 barrel interface threads
30 hub front shaft
31 cam retainer well
32 cam follower
33 spring cavity
34 striker aperture
35 rifle bore
36 cam stop
37 firing position
38 not used
39 not used
40 not used
41 handguard
42 cooling aperture
43 handguard screws
44 front grip
45 grip retainer
46 grip retainer screw
47 grip alignment pin
48 screw aperture
49 not used
50 front housing
51 front shaft bearing
52 front barrel hub bearing
53 front housing screw boss
54 cooling aperture
55 exit aperture
56 not used
57 not used
58 not used
59 not used
60 half-chamber chain
61 chain link pin
62 pin aperture
63 chain half-chamber
64 link pressure face
65 not used
66 half-chamber chain link
67 ejection drive sprocket
68 drive sprocket set screw
69 drive sprocket aperture
70 sprocket cradle
71 chain idler shaft
72 idler shaft bushing
73 idler sprocket
74 pressure fence

75 stop surface
76 retaining screws
77 input drive sprocket
78 not used
79 not used
80 mainframe housing
81 front housing screw
82 chain drive shaft
83 rear chain shaft bearing
84 chain shaft gear
85 shaft gear set screw
86 mid-shaft bearing
87 rear barrel hub bearing
88 safety stop pin
89 eccentric safety shaft
90 safety actuator
91 safety actuator aperture
92 eccentric shaft set screw
93 spring clip
94 not used
95 not used
96 not used
97 not used
98 not used
99 not used
100 motor
101 drive gear housing
102 drive gear housing screw
103 drive gear bushings
104 drive gear
105 driven gear housing screw
106 driven gear housing
107 driven gear
108 drive chain gear
109 driven gear screw
110 chamber chain gear set screw
111 drive gear set screw
112 not used
113 not used
114 not used
115 not used
116 not used
117 not used
118 not used
119 not used
120 motor housing
121 motor terminal screw
122 positive magnet
123 shoulder washer
124 plastic washer
125 motor ring terminal
126 nut
127 motor housing screw
128 left trigger grip
129 right trigger grip
130 trigger grip retainer
131 trigger grip retainer screw
132 power switch
133 trigger lever
134 rear handle
135 negative magnet
136 not used
137 not used
138 not used
139 not used
140 battery housing
141 battery housing cover
142 cover screw
143 switch
144 battery
145 contact stand-off
146 ring terminal
147 terminal screw
148 positive magnetic contact
149 magnet screw
150 negative magnetic contact
151 battery assembly aperture
152 not used
153 not used
154 not used
155 not used
156 not used
157 not used
158 not used
159 not used
160 receiver body
161 ejection pawl
162 magazine release
163 magazine release actuator
164 magazine retainer pawl
165 magazine release spring
166 receiver screw
167 solution
168 not used
169 empty cartridge
170 magazine lid
171 magazine housing
172 cartridge belt
173 cartridge
174 high-temperature polyimide belt
175 loader boss
176 dampener spring
177 magazine retainer aperture

What is claimed is:

1. A multi-barrel split-breech rapid fire gun comprising:

(a) a housing with a handle and trigger positioned thereon, the trigger operatively connected to a motor drive assembly;

(b) a motor drive assembly arranged within the housing having a rotation member that rotates when the trigger is actuated;

(c) a chain drive assembly that is operatively connected to the rotation member of the motor drive assembly, the chain drive assembly comprising an endless belt having a plurality of connected, individual links, with each individual link having a half breech or chamber formed thereon and in which the endless belt is configured to rotate within the gun when the trigger is actuated;

(d) a firing assembly that is adjacent to and operatively connected to the chain drive assembly and motor drive assembly, the firing assembly comprising:

(i) a plurality of rotatable barrels arranged on the multi-barrel split-breech rapid fire gun that are spaced apart from the trigger;

(ii) a rotatable barrel hub with a plurality of cartridge half breeches or chambers formed thereon, the rotatable barrel hub synchronously rotates with the individual links of the endless belt such that each cartridge half breech or chamber formed on the rotatable barrel hub is configured to align with a corresponding half breech or chamber formed on each individual link of the endless belt to form a complete cartridge breech or chamber that is configured to temporarily house a cartridge therein before firing the cartridge through one barrel of the plurality of rotatable barrels; and (iii) a cartridge inlet configured to align with a cartridge magazine and a spent cartridge outlet arranged opposite to the cartridge inlet; and (e) optionally a cartridge magazine configured to releasably and securely mate to the housing and align with the cartridge inlet such that cartridges are fed from the magazine through the cartridge inlet into the complete cartridge breech or chamber formed by the aligned half breeches or chambers and rotate through the firing assembly such that spent cartridges exit the cartridge outlet such that the spent cartridges remain linked to one another after exiting the cartridge outlet.

2. The multi-barrel split-breech rapid fire gun of claim 1, wherein the cartridge magazine is present.

3. The multi-barrel split-breech rapid fire gun of claim 2, wherein the cartridge magazine houses a plurality of connected cartridges with each cartridge connected to another cartridge by a flexible polymeric belt and includes a lubricating solution that partially coats the plurality of connected cartridges therein.

4. The multi-barrel split breech rapid fire gun of claim 3, wherein the lubricating solution is configured to cool and lubricate the firing assembly when firing cartridges from the gun and comprises a mixture of water, an unsaturated polyol, and silicone.

5. The multi-barrel split breech rapid fire gun of claim 4, wherein the firing assembly further comprises a plurality of biased rotatable firing pins, with at least one firing pin of the plurality of biased rotatable firing pins configured to axially align with the complete cartridge breech or chamber formed within the gun while in use and to move in a linear direction from the handle towards one barrel of the plurality of rotatable barrels to fire the cartridge through one barrel of the plurality of rotatable barrels.

6. The multi-barrel split breech rapid fire gun of claim 5, wherein the rotation member of motor drive assembly comprises a plurality of sprockets that are operatively connected to a drive motor, the plurality of sprockets are arranged to contact an inner surface of the endless belt and rotate the endless belt within the multi-barrel split breech rapid fire gun.

7. The multi-barrel split breech rapid fire gun of claim 6, wherein the half breech or chamber of each link is formed on an outer surface of the endless belt opposite the inner surface of the endless belt.

8. The multi-barrel split breech rapid fire gun of claim 7, further comprising a firing pin cam that houses the plurality of firing pins therein, an inner surface of the firing pin cam arranged as partially concentric rings having raised and recess portions in which when each rotatable firing pin rotates immediately from the raised to recess portion of the firing pin cam the firing pin moves radially outward aligning with a biasing cavity that biases the firing pin in a linear direction from the handle towards one barrel of the plurality of rotatable barrels to fire the cartridge through one barrel of the plurality of rotatable barrels.

9. The multi-barrel split breech rapid fire gun of claim 8, wherein the multi-barrel split breech rapid fire gun is an automatic or semi-automatic firearm.

10. The multi-barrel split breech rapid fire gun of claim 9, wherein the multi-barrel split breech rapid fire gun is a semi-automatic firearm.

11. A plurality of assemblies configured for a multi-barrel split-breech rapid fire gun, the plurality of assemblies comprising:

(a) a chain drive assembly that configure to be operatively connected to a rotation member of a motor drive assembly in a multi-barrel split-breech rapid fire gun, the chain drive assembly comprising an endless belt having a plurality of connected, individual links, with each individual link having a half breech or chamber formed thereon and in which the endless belt is configured to rotate within the gun when a trigger is actuated; and (b) a firing assembly configured to be adjacent to and operatively connected to the chain drive assembly, the firing assembly comprising:

(i) a plurality of rotatable barrels to be arranged on the multi-barrel split-breech rapid fire gun;

(ii) a rotatable barrel hub with a plurality of cartridge half breeches or chambers formed thereon, the rotatable barrel hub configured to synchronously rotate with the individual links of the endless belt such that each cartridge half breech or chamber formed on the rotatable barrel hub is configured to align with a corresponding half breech or chamber formed on each individual link of the endless belt to form a complete cartridge breech or chamber that is configured to temporarily house a cartridge therein before firing a cartridge through one barrel of the plurality of rotatable barrels; and (iii) a cartridge inlet configured to align with a cartridge magazine and a spent cartridge outlet arranged opposite to the cartridge inlet.

12. The plurality of assemblies of claim 11, further comprising: (c) a cartridge magazine configured to releasably and securely align with the cartridge inlet such that cartridges are configured to be fed from the magazine through the cartridge inlet into the complete cartridge breech or chamber formed by the aligned half breeches or chambers and rotate through the firing assembly such that spent cartridges exit the cartridge outlet such that the spent cartridges remain linked to one another after exiting the cartridge outlet.

13. The plurality of assemblies of claim 12, wherein the cartridge magazine houses a plurality of connected cartridges with each cartridge connected to another cartridge by a flexible polymeric belt and includes a lubricating solution that partially coats the plurality of connected cartridges therein.

14. The plurality of assemblies of claim 13, wherein the lubricating solution is configured to cool and lubricate the firing assembly when firing cartridges from the gun and comprises a mixture of water, an unsaturated polyol, and silicone.

15. The plurality of assemblies of claim 14, wherein the firing assembly further comprises a plurality of biased rotatable firing pins, with at least one firing pin of the plurality of biased rotatable firing pins configured to axially align with the complete cartridge breech or chamber formed within the gun while in use and to move in a linear direction from the handle towards one barrel of the plurality of rotatable barrels to fire the cartridge through one barrel of the plurality of rotatable barrels.

16. The plurality of assemblies of claim 15, wherein the half breech or chamber of each link is formed on an outer surface of the endless belt opposite the inner surface of the endless belt, with the inner surface of the endless belt configured to directly contact a rotation member of a motor drive assembly.

17. The plurality of assemblies of claim 15, further comprising a firing pin cam that houses the plurality of firing pins therein, an inner surface of the firing pin cam arranged as partially concentric rings having raised and recess portions in which when each rotatable firing pin rotates immediately from the raised to recess portion of the firing pin cam the firing pin moves radially outward aligning with a biasing cavity that biases the firing pin in a linear direction from the handle towards one barrel of the plurality of rotatable barrels to fire the cartridge through one barrel of the plurality of rotatable barrels.

* * * * *